US010395670B1

(12) United States Patent
Nonaka et al.

(10) Patent No.: US 10,395,670 B1
(45) Date of Patent: Aug. 27, 2019

(54) DIAGNOSIS METHOD, DIAGNOSIS DEVICE, AND COMPUTER-READABLE RECORDING MEDIUM WHICH RECORDS DIAGNOSIS PROGRAM

(71) Applicant: Panasonic Intellectual Property Management Co., Ltd., Osaka (JP)

(72) Inventors: Masao Nonaka, Osaka (JP); Yuji Osaki, Osaka (JP); Hiroko Sugimoto, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/200,842

(22) Filed: Nov. 27, 2018

(30) Foreign Application Priority Data

Feb. 23, 2018 (JP) ..... 2018-030473

(51) Int. Cl.
*G10L 25/51* (2013.01)

(52) U.S. Cl.
CPC ..... *G10L 25/51* (2013.01)

(58) Field of Classification Search
None
See application file for complete search history.

(56) References Cited

U.S. PATENT DOCUMENTS

2006/0045289 A1 3/2006 Kujirai et al.
2012/0219157 A1* 8/2012 Hosaka ..... G01H 3/08 381/56
2016/0112602 A1* 4/2016 Kawai ..... H04N 1/32635 358/1.14
2017/0103776 A1* 4/2017 Kim ..... G10L 25/51
2018/0350167 A1* 12/2018 Ekkizogloy ..... G07C 5/0808

FOREIGN PATENT DOCUMENTS

JP 2006-60720 3/2006
WO 2015/068446 5/2015

* cited by examiner

*Primary Examiner* — Paul W Huber
(74) *Attorney, Agent, or Firm* — Wenderoth, Lind & Ponack, L.L.P.

(57) ABSTRACT

A diagnosis method includes giving an instruction to present at least two sound collection positions of an abnormal sound of an electric apparatus to an outside; comparing a current position of the diagnosis device and one sound collection position of the at least two sound collection positions; obtaining sound data indicative of an abnormal sound of the electric apparatus collected by a microphone, based on a comparison result and storing the sound data in a sound data storage portion so as be correlated with log data and the one sound collection position; and diagnosing an abnormal sound of the electric apparatus by using at least two items of sound data and at least two sound collection positions, based on a determination result whether sound collection is completed and a determination result whether diagnosis of an abnormal sound is possible.

11 Claims, 23 Drawing Sheets

FIG. 3

| TIME STAMP | DRIVE MODE INFORMATION | ROOM FAN OPERATION INFORMATION | LOUVER OPERATION INFORMATION |
|---|---|---|---|
| 12/28/2017 11:51 | STOP | STOP | STOP |

FIG. 5

302

| TIME STAMP | DRIVE MODE INFORMATION | ROOM FAN OPERATION INFORMATION | LOUVER OPERATION INFORMATION |
|---|---|---|---|
| 6/28/2017 14:03 | COOLING | STOP | STOP |

FIG. 6

304

| MODEL | DIAGNOSIS TARGET PART | SOUND COLLECTION ORDER | SOUND COLLECTION POSITION | SOUND COLLECTION TIME (SECOND) |
|---|---|---|---|---|
| AC1 | ROOM FAN | 1 | A | 10 |
| AC1 | ROOM FAN | 2 | B | 10 |
| AC1 | ROOM FAN | 3 | C | 10 |
| AC1 | LOUVER | 1 | E | 5 |
| AC1 | LOUVER | 2 | F | 5 |
| AC1 | LOUVER | 3 | G | 5 |
| ... | ... | ... | ... | ... |

FIG. 7

308

| SOUND COLLECTION ORDER | SOUND COLLECTION POSITION | DRIVE MODE INFORMATION | ROOM FAN OPERATION INFORMATION | LOUVER OPERATION INFORMATION | SOUND DATA |
|---|---|---|---|---|---|
| 1 | A | COOLING | DRIVE | DRIVE | 12345 |
| 2 | B | COOLING | DRIVE | DRIVE | 67890 |
| 3 | C | COOLING | DRIVE | STOP | ABCDE |

FIG. 8

308

| SOUND COLLECTION ORDER | SOUND COLLECTION POSITION | DRIVE MODE INFORMATION | ROOM FAN OPERATION INFORMATION | LOUVER OPERATION INFORMATION | SOUND DATA |
|---|---|---|---|---|---|
| 1 | A | COOLING | DRIVE | DRIVE | 12345 |
| 2 | B | COOLING | DRIVE | DRIVE | 67890 |
| 3 | C | STOP | STOP | STOP | ABCDE |

FIG. 22

304

| MODEL | DIAGNOSIS TARGET PART | SOUND COLLECTION ORDER | SOUND COLLECTION POSITION | SOUND COLLECTION TIME (SECOND) |
|---|---|---|---|---|
| AC1 | ROOM FAN | 1 | A | 10 |
| AC1 | ROOM FAN | 2 | LEFT 10cm | 10 |
| AC1 | ROOM FAN | 3 | UP 10cm | 10 |
| AC1 | LOUVER | 1 | E | 5 |
| AC1 | LOUVER | 2 | LEFT 10cm | 5 |
| AC1 | LOUVER | 3 | DOWN 10cm | 5 |
| ... | ... | ... | ... | ... |

DIAGNOSIS METHOD, DIAGNOSIS DEVICE, AND COMPUTER-READABLE RECORDING MEDIUM WHICH RECORDS DIAGNOSIS PROGRAM

FIELD OF THE INVENTION

The present disclosure relates to a diagnosis method, a diagnosis device, and a computer-readable recording medium which records a diagnosis program for diagnosing an abnormal sound of an electric apparatus.

BACKGROUND ART

There have been developed diagnosis devices for abnormal sounds of electric apparatuses. For example, PCT International Publication No. 2015/068446 discloses an abnormal sound diagnosis device which obtains a time-frequency distribution by spectral analysis of an operating sound to be diagnosed, detects a specific component defined in advance from the time-frequency distribution, counts the number of detection of the specific component in the time-frequency distribution, and compares a specific component count value during normal operation and a specific component count value at the time of diagnosis to determine an increase not less than a set value to be abnormal.

As after-sales service of common home electrical appliances, some technical staffs are dispatched to houses of users of home electrical appliances to diagnose abnormal sounds of the home electrical appliances. On this occasion, various interference sound sources (noises) are inevitable in the users' houses. When a technical staff diagnoses an abnormal sound of a home electrical appliance at a user's house by using the abnormal sound diagnosis device disclosed in PCT International Publication No. 2015/068446, an interference sound source, if present, causes reduction in diagnosis precision of an abnormal sound by the abnormal sound diagnosis device. Therefore, it is demanded to reduce influences of an interference sound source as much as possible.

Regarding the problem, for example, Japanese Unexamined Patent Application Publication No. 2006-60720 discloses a sound collection system which emphasizes and records a sound from a target sound source under the presence of an interference sound source. According to the technique disclosed in Japanese Unexamined Patent Application Publication No. 2006-60720, at least one microphone collects a sound while rotating around a rotational shaft to conduct filter processing corresponding to positional information of the microphone at each time point. This enables removal of a sound from an interference sound source, as well as enabling a sound from a target sound source to be emphasized and recorded.

The above-described conventional technique, however, needs a mechanism for rotating at least one microphone, so that further improvement is required.

SUMMARY OF THE INVENTION

The present disclosure, which is directed to solving the above problem, aims at providing a diagnosis method, a diagnosis device, and a computer-readable recording medium which records a diagnosis program enabling diagnosis of an abnormal sound with high precision by simple configuration.

A diagnosis method according to one aspect of the present disclosure is a diagnosis method in a diagnosis device which diagnoses an abnormal sound of an electric apparatus, the diagnosis method including: from a sound collection position storage portion which stores at least two sound collection positions of an abnormal sound of the electric apparatus, obtaining the at least two sound collection positions and giving an instruction to present the at least two sound collection positions to an outside; comparing a current position of the diagnosis device and one sound collection position of the at least two sound collection positions presented; obtaining sound data indicative of an abnormal sound of the electric apparatus collected by a microphone, based on a comparison result and storing the obtained sound data in a sound data storage portion so as to be correlated with log data obtained from the electric apparatus and the one sound collection position; determining whether sound collection at the at least two sound collection positions presented is completed; determining whether diagnosis of an abnormal sound of the electric apparatus is possible, based on at least two items of log data correlated with at least two items of sound data stored in the sound data storage portion; and diagnosing an abnormal sound of the electric apparatus by using the at least two items of sound data and at least two sound collection positions correlated with the at least two items of sound data which are stored in the sound data storage portion, based on a determination result whether sound collection is completed and a determination result whether diagnosis of an abnormal sound is possible.

BRIEF DESCRIPTION OF THE DRAWINGS

FIG. 3 is a diagram showing one example of log data in the present embodiment;

FIG. 5 is a diagram showing one example of a data configuration of a log storage portion in the present embodiment;

FIG. 6 is a diagram showing one example of a data configuration of a sound collection positional information storage portion in the present embodiment;

FIG. 7 is a diagram showing one example of a data configuration of a sound data storage portion in the present embodiment;

FIG. 8 is a diagram showing another example of a data configuration of the sound data storage portion in the present embodiment;

FIG. 22 is a diagram showing one example of a data configuration of a sound collection positional information storage portion in a first modification of the present embodiment.

Figure 1:
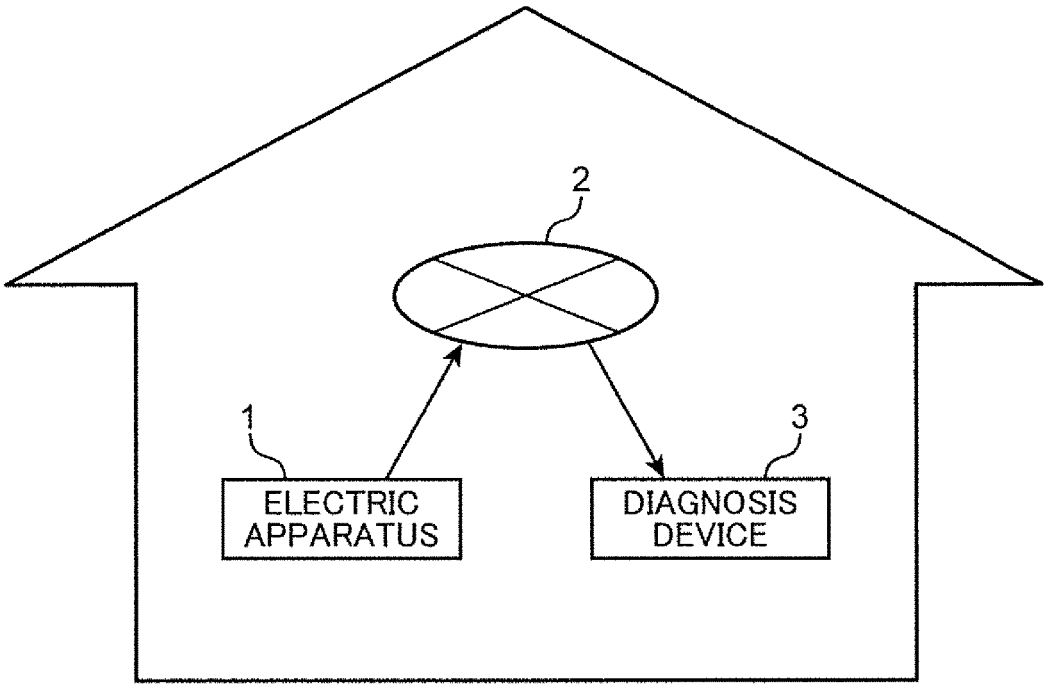
FIG. 1 is a diagram showing a configuration of a diagnosis system in the present embodiment.

DESCRIPTION OF EMBODIMENTS (Knowledge on which the Present Disclosure is Based)

In a conventional sound collection system as described above, two microphones are fixed at both ends of a support bar with the center thereof fixed to a rotational shaft so that the rotational shaft is rotated by a motor. Then, the two microphones collect sound while rotating around the rotational shaft to conduct filter processing corresponding to positional information of the microphones at each time point. This enables removal of a sound from an interference sound source, as well as enabling a sound from a target sound source to be emphasized and recorded. In a case of diagnosing only an apparatus whose installation place is fixed, a conventional sound collection system is effective.

However, in a case where a technical staff diagnoses an abnormal sound of an electric apparatus at a user's house, it is necessary to carry a sound collection system to the user's house and such a method, as disclosed in Japanese Unexamined Patent Application Publication No. 2006-60720, of collecting sound while rotating at least one microphone around the rotational shaft is not practical.

In order to solve the above problem, a diagnosis method according to one aspect of the present disclosure is a diagnosis method in a diagnosis device which diagnoses an abnormal sound of an electric apparatus, the diagnosis method including: from a sound collection position storage portion which stores at least two sound collection positions of an abnormal sound of the electric apparatus, obtaining the at least two sound collection positions and giving an instruction to present the at least two sound collection positions to an outside; comparing a current position of the diagnosis device and one sound collection position of the at least two sound collection positions presented; obtaining sound data indicative of an abnormal sound of the electric apparatus collected by a microphone, based on a comparison result and storing the obtained sound data in a sound data storage portion so as to be correlated with log data obtained from the electric apparatus and the one sound collection position; determining whether sound collection at the at least two sound collection positions presented is completed; determining whether diagnosis of an abnormal sound of the electric apparatus is possible, based on at least two items of log data correlated with at least two items of sound data stored in the sound data storage portion; and diagnosing an abnormal sound of the electric apparatus by using the at least two items of sound data and at least two sound collection positions correlated with the at least two items of sound data which are stored in the sound data storage portion, based on a determination result whether sound collection is completed and a determination result whether diagnosis of an abnormal sound is possible.

According to the configuration, at least two sound collection positions are obtained from the sound collection position storage portion which stores at least two sound collection positions of an abnormal sound of the electric apparatus. It is instructed to present at least two sound collection positions to the outside. A current position of the diagnosis device and one sound collection position of the at least two sound collection positions presented are compared. Based on the comparison result, sound data indicative of an abnormal sound of the electric apparatus collected by a microphone is obtained. The obtained sound data is stored in the sound data storage portion so as to be correlated with log data obtained from the electric apparatus and the one sound collection position. Determination is made whether sound collection at the at least two sound collection positions presented is completed. Determination whether diagnosis of an abnormal sound of the electric apparatus is possible is made based on at least two items of log data correlated with at least two items of sound data stored in the sound data storage portion. An abnormal sound of the electric apparatus is diagnosed by using the at least two items of sound data and at least two sound collection positions correlated with the at least two items of sound data which are stored in the sound data storage portion, based on a determination result whether sound collection is completed and a determination result whether diagnosis of an abnormal sound is possible.

Accordingly, since sound data indicative of an abnormal sound of the electric apparatus collected by a single microphone is obtained at at least two sound collection positions and an abnormal sound of the electric apparatus is diagnosed by using at least two items of sound data and at least two sound collection positions, an abnormal sound can be diagnosed with high precision by simple configuration.

In the above diagnosis method, in the determination whether diagnosis of an abnormal sound of the electric apparatus is possible, the determination may be made that diagnosis of an abnormal sound of the electric apparatus is possible in a case where all of predetermined items are identical to each other in the at least two items of log data.

According to the configuration, in the determination whether diagnosis of an abnormal sound of an electric apparatus is possible, the determination is made that diagnosis of an abnormal sound of the electric apparatus is possible in a case where all of predetermined items are identical to each other in at least two items of log data.

Accordingly, since operation states in an electric apparatus are all identical to each other at the time when at least two items of sound data is obtained, an abnormal sound of the electric apparatus can be diagnosed with higher precision.

Also in the above diagnosis method, the determination whether diagnosis of an abnormal sound of the electric apparatus is possible may be made after determination is made that sound collection at the at least two sound collection positions is completed.

According to the configuration, in the determination whether diagnosis of an abnormal sound of the electric apparatus is possible, the determination is made after the determination that sound collection at at least two sound collection positions is completed is made.

Accordingly, the determination whether diagnosis of an abnormal sound of the electric apparatus is possible is made not every time sound collection is conducted at each of at least two sound collection positions but after sound collection at at least two sound collection positions is completed, and therefore unnecessary determination processing can be reduced.

Further in the above diagnosis method, after obtaining sound data indicative of an abnormal sound of the electric apparatus, the log data of the electric apparatus may be obtained and the determination whether diagnosis of an abnormal sound of the electric apparatus is possible may be made every time the log data is obtained.

According to the configuration, after obtaining sound data indicative of an abnormal sound of the electric apparatus, the log data of the electric apparatus is obtained. In the determination whether diagnosis of an abnormal sound of the electric apparatus is possible, the determination is made every time the log data is obtained.

Accordingly, since it is determined whether diagnosis of an abnormal sound of the electric apparatus is possible every time sound data is obtained and log data is obtained, it is possible to stop sound collection at the time point of determination that diagnosis of an abnormal sound of the electric apparatus is impossible, thereby reducing unnecessary sound collection processing.

Also in the above diagnosis method, the diagnosis of an abnormal sound of the electric apparatus may be conducted by emphasizing an abnormal sound of the electric apparatus and diagnosing the emphasized abnormal sound using the at least two items of sound data and the at least two sound collection positions which are stored in the sound data storage portion.

According to the configuration, in the diagnosis of an abnormal sound of an electric apparatus, an abnormal sound of the electric apparatus is emphasized and the emphasized abnormal sound is diagnosed using at least two items of sound data and at least two sound collection positions which are stored in the sound data storage portion.

Accordingly, since an abnormal sound of an electric apparatus is emphasized, it is possible to remove noise other than an abnormal sound of the electric apparatus, thereby enabling diagnosis of an abnormal sound with higher precision.

Also in the above diagnosis method, the sound collection position storage portion stores a model of the electric apparatus, a diagnosis target part corresponding to the abnormal sound in the electric apparatus, and the at least two sound collection positions so as to be correlated with each other, and further, model information for specifying the model of the electric apparatus, and diagnosis target part information for specifying the diagnosis target part in the electric apparatus may be obtained, and in the instruction to present the at least two sound collection positions, the at least two sound collection positions correlated with the obtained model information and diagnosis target part information may be obtained from the sound collection position storage portion.

According to the configuration, the sound collection position storage portion stores a model of the electric apparatus, a diagnosis target part corresponding to the abnormal sound in the electric apparatus, and at least two sound collection positions so as to be correlated with each other. Model information for specifying the model of the electric apparatus, and diagnosis target part information for specifying the diagnosis target part in the electric apparatus are obtained. In the instruction to present at least two sound collection positions, the at least two sound collection positions correlated with the obtained model information and diagnosis target part information are obtained from the sound collection position storage portion.

Accordingly, at least two sound collection positions can be specified according to a model of an electric apparatus and a diagnosis target part in the electric apparatus, so that an abnormal sound can be diagnosed for each diagnosis target part.

Also the above diagnosis method may further include receiving the log data from the electric apparatus, storing the received log data in a log storage portion, and obtaining the log data from the log storage portion after obtaining sound data indicative of an abnormal sound of the electric apparatus.

According to the configuration, log data is received from an electric apparatus. The received log data is stored in the log storage portion. After obtaining sound data indicative of an abnormal sound of the electric apparatus, the log data is obtained from the log storage portion.

Accordingly, since log data is not received from an electric apparatus every time sound data is obtained but already stored log data is obtained from the log storage portion every time sound data is obtained, a communication load on reception of log data can be mitigated.

Further in the above diagnosis method, an instruction to present a diagnosis result may be given. According to the configuration, since a diagnosis result of an abnormal sound is presented, a technical staff is allowed to check a diagnosis result.

Also in the above diagnosis method, position specifying information for specifying the at least two sound collection positions is applied to a surface of the electric apparatus. The above diagnosis method may further include obtaining an image of the electric apparatus photographed by a photographing portion provided in the diagnosis device, and displaying the obtained image on a display portion provided in the diagnosis device, in which in the comparison between the current position of the diagnosis device and the one sound collection position, determination may be made whether the image displayed on the display portion includes the position specifying information corresponding to the one sound collection position of the presented at least two sound collection positions.

According to the configuration, position specifying information for specifying at least two sound collection positions is applied to a surface of the electric apparatus. An image of the electric apparatus photographed by a photographing portion provided in the diagnosis device is obtained. The obtained image is displayed on a display portion provided in the diagnosis device. In the comparison between a current position of the diagnosis device and one sound collection position, determination is made whether an image displayed on the display portion includes the position specifying information corresponding to one sound collection position of the presented at least two sound collection positions.

Accordingly, it is possible to easily determine whether a current position of the diagnosis device is one sound collection position by determining whether position specifying information applied to the surface of the electric apparatus is included in an image photographed by the photographing portion.

A diagnosis device according to another aspect of the present disclosure is a diagnosis device for diagnosing an abnormal sound of an electric apparatus, including a sound collection position storage portion which stores at least two sound collection positions of an abnormal sound of the electric apparatus; an instruction portion which obtains the at least two sound collection positions from the sound collection position storage portion to give an instruction to present the at least two sound collection positions to an outside; a comparison portion which compares a current position of the diagnosis device and one sound collection position of the at least two sound collection positions presented; a sound data storage portion which stores at least two items of sound data, at least two items of log data of the electric apparatus, and the at least two sound collection positions so as to be correlated with each other; a sound collection portion which obtains sound data indicative of an abnormal sound of the electric apparatus collected by a microphone, based on a comparison result, and stores the obtained sound data in the sound data storage portion so as to be correlated with the log data obtained from the electric apparatus and the one sound collection position; a completion determination portion which determines whether sound collection at the at least two sound collection positions presented is completed; a diagnosis determination portion which determines whether diagnosis of an abnormal sound of the electric apparatus is possible, based on at least two items of log data correlated with at least two items of sound data stored in the sound data storage portion; and a diagnosis portion which diagnoses an abnormal sound of the electric apparatus by using the at least two items of sound data stored in the sound data storage portion and at least two sound collection positions correlated with the at least two items of sound data, based on a determination result of the completion determination portion and a determination result of the diagnosis determination portion.

According to the configuration, at least two sound collection positions of an abnormal sound of the electric apparatus are stored in the sound collection position storage portion. At least two sound collection positions are obtained from the sound collection position storage portion and it is instructed to present at least two sound collection positions to the outside. A current position of the diagnosis device and one sound collection position of the at least two sound collection positions presented are compared. At least two items of sound data, at least two items of log data of the electric apparatus, and the at least two sound collection positions are stored in the sound data storage portion so as to be correlated with each other. Sound data indicative of an abnormal sound of the electric apparatus collected by a microphone is obtained based on a comparison result and is stored in the sound data storage portion so as to be correlated with log data obtained from the electric apparatus and one sound collection position. Determination is made whether sound collection at the at least two sound collection positions presented is completed. Determination is made whether diagnosis of an abnormal sound of the electric apparatus is possible, based on at least two items of log data correlated with at least two items of sound data stored in the sound data storage portion. An abnormal sound of the electric apparatus is diagnosed by using the at least two items of sound data and at least two sound collection positions correlated with the at least two items of sound data which are stored in the sound data storage portion, based on a determination result whether sound collection is completed and a determination result whether diagnosis of an abnormal sound is possible.

Accordingly, since sound data indicative of an abnormal sound of the electric apparatus collected by a single microphone is obtained at each of at least two sound collection positions, and an abnormal sound of the electric apparatus is diagnosed using at least two items of sound data and at least two sound collection positions, an abnormal sound can be diagnosed with high precision by simple configuration.

A computer-readable recording medium which records a diagnosis program according to another aspect of the present disclosure is a computer-readable recording medium which records a diagnosis program for diagnosing an abnormal sound of an electric apparatus, in which the diagnosis program causes a processor to execute the processing of, from a sound collection position storage portion which stores at least two sound collection positions of an abnormal sound of the electric apparatus, obtaining the at least two sound collection positions to give an instruction to present the at least two sound collection positions to an outside; comparing a current position of the diagnosis device and one sound collection position of the at least two sound collection positions presented; obtaining sound data indicative of an abnormal sound of the electric apparatus collected by a microphone, based on a comparison result and storing the obtained sound data in a sound data storage portion so as to be correlated with log data obtained from the electric apparatus and the one sound collection position; determining whether sound collection at the at least two sound collection positions presented is completed; determining whether diagnosis of an abnormal sound of the electric apparatus is possible, based on at least two items of log data correlated with at least two items of sound data stored in the sound data storage portion; and diagnosing an abnormal sound of the electric apparatus by using the at least two items of sound data and at least two sound collection positions correlated with the at least two items of sound data which are stored in the sound data storage portion, based on a determination result whether sound collection is completed and a determination result whether diagnosis of an abnormal sound is possible.

According to the configuration, at least two sound collection positions are obtained from the sound collection position storage portion which stores at least two sound collection positions of an abnormal sound of the electric apparatus. It is instructed to present at least two sound collection positions to the outside. A current position of the diagnosis device and one sound collection position of the at least two sound collection positions presented are compared. Sound data indicative of an abnormal sound of the electric apparatus collected by a microphone is obtained based on a comparison result. The obtained sound data is stored in the sound data storage portion so as to be correlated with log data obtained from the electric apparatus and the one sound collection position. Determination is made whether sound collection at the at least two sound collection positions presented is completed. Determination is made whether diagnosis of an abnormal sound of the electric apparatus is possible, based on at least two items of log data correlated with at least two items of sound data stored in the sound data storage portion. An abnormal sound of the electric apparatus is diagnosed by using the at least two items of sound data and at least two sound collection positions correlated with the at least two items of sound data which are stored in the sound data storage portion, based on a determination result whether sound collection is completed and a determination result whether diagnosis of an abnormal sound is possible.

Accordingly, since sound data indicative of an abnormal sound of the electric apparatus collected by a single microphone is obtained at each of at least two sound collection positions, and an abnormal sound of the electric apparatus is diagnosed using at least two items of sound data and at least two sound collection positions, an abnormal sound can be diagnosed with high precision by simple configuration.

Embodiments

Embodiments of the present disclosure will be described with reference to the accompanying drawings in the following. The embodiments described below each show one specific example of the present disclosure. Numerical values, shapes, components, steps, and the order of steps shown in the following embodiments are all by way of one example and not intended to limit the present disclosure. Among the components in the embodiments below, components not recited in an independent claim reciting a most significant concept will be described as an optional component. Contents of each component can be combined in every embodiment.

In the following, a diagnosis system as one example of an embodiment of the present disclosure will be described with reference to the drawings.

First, description will be made of an overall picture of the diagnosis system in the present embodiment.

FIG. 1 is a diagram showing a configuration of the diagnosis system in the present embodiment. The diagnosis system includes an electric apparatus 1 and a diagnosis device 3 as shown in FIG. 1. The electric apparatus 1 is an abnormal sound diagnosis target apparatus, for which the diagnosis device 3 conducts abnormal sound diagnosis processing.

The electric apparatus 1 is communicably connected with the diagnosis device 3 via a short-distance radio communication path 2. The electric apparatus 1 is a home electrical appliance such as a television set, a recorder, an air conditioner, a refrigerator, a washing machine, a microwave oven, or a rice cooker. The short-distance radio communication path 2 is, for example, radio local area network (LAN) or Bluetooth (registered trademark). The short-distance radio communication path 2 is one example of a network. The electric apparatus 1 and the diagnosis device 3 may be communicably connected with each other via the Internet.

The diagnosis device 3 is an information terminal such as a smartphone, a tablet type computer, or a personal computer equipped with a touch screen, a microphone, and a camera.

In the present embodiment, description will be made of an example where the electric apparatus 1 is an air conditioner. The present disclosure is, however, not limited to an air conditioner but is applicable to any electric apparatus.

Description will be first made of image of use of the present embodiment, and then, detailed description will be made of each device forming the diagnosis system.

For example, the electric apparatus 1 is an air conditioner disposed in a common user's house. The user being dissatisfied with an abnormal sound of the air conditioner inquires of a manufacturer of an air conditioner. Upon receiving an inquiry from the user, a technical staff visits the user's house. The technical staff uses the diagnosis device 3 that the staff brought to diagnose an abnormal sound of the electric apparatus 1 and conduct appropriate repair. The present embodiment is on the assumption of the foregoing image of use.

While in the present embodiment, description will be made of an example where a technical staff of a manufacturer of the electric apparatus 1 uses the diagnosis device 3, the user of the electric apparatus 1 may use the diagnosis device 3.

Subsequently, the electric apparatus 1 will be described.

Figure 2:
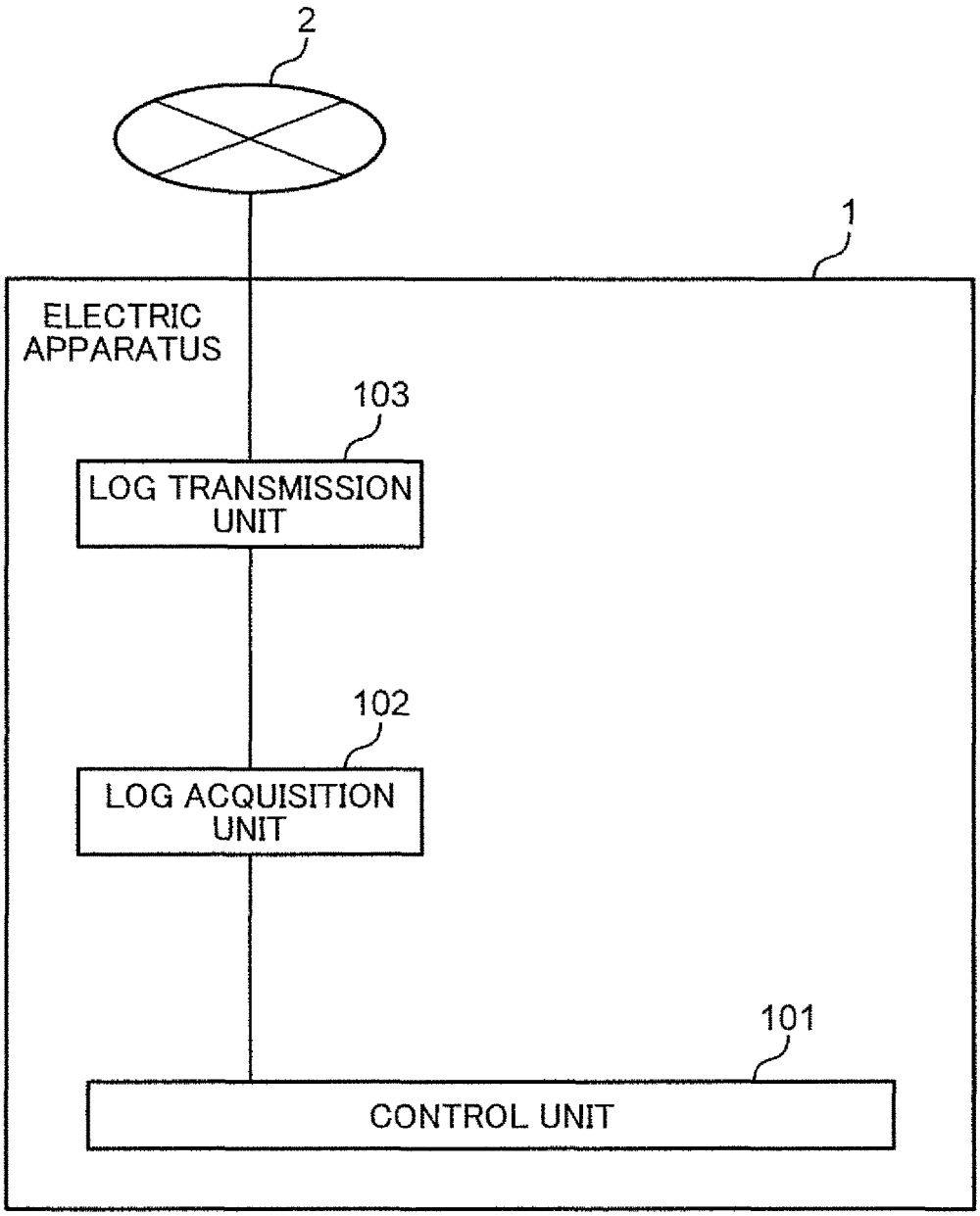
FIG. 2 is a diagram showing a configuration of an electric apparatus in the present embodiment.

FIG. 2 is a diagram showing a configuration of the electric apparatus in the present embodiment. The electric apparatus 1 includes a control unit 101, a log acquisition unit 102, and a log transmission unit 103 as shown in FIG. 2.

The control unit 101 controls a main function of the electric apparatus 1. The main function of the electric apparatus 1 varies with a type of the electric apparatus 1. In the present embodiment, since the electric apparatus 1 is an air conditioner, the main function includes, for example, a cooling function of discharging cool air, a function of rotating a room fan, a function of moving a louver, and the like. In a case where the electric apparatus 1 is a refrigerator, the main function is, for example, a cooling function of cooling the inside of the refrigerator using a compressor, and in a case where the electric apparatus 1 is a washing machine, the main function includes, for example, a washing function of washing laundry by using tap water and detergent and a drying function of drying laundry. The control unit 101 controls a part such as a compressor or a fan (not shown in FIG. 2) provided in a main body (the electric apparatus 1) of the air conditioner according to user's operation.

The log acquisition unit 102 generates log data at timing when a state of the electric apparatus 1 changes in course of control by the control unit 101. The log data is data indicative of, for example, time stamp, drive condition, operation time and date, sensor value, and the like.

FIG. 3 is a diagram showing one example of log data in the present embodiment. In the present embodiment, the log data includes time stamp, drive mode information, room fan operation information, and louver operation information as shown in FIG. 3. The drive mode information indicates drive modes of the electric apparatus 1 such as cooling, heating or stop. The room fan operation information indicates whether the room fan is in operation or at a stop. The louver operation information indicates whether the louver is in operation or at a stop. The log data, not limited to these kinds of information, may include other information indicative of states of the electric apparatus 1 which can be obtained. The log data may include, for example, identification information for identifying the electric apparatus 1. Then, the log acquisition unit 102 outputs the generated log data to the log transmission unit 103.

The log transmission unit 103 transmits log data obtained from the log acquisition unit 102 to the diagnosis device 3 via the short-distance radio communication path 2.

Subsequently, the diagnosis device 3 will be described.

Figure 4:
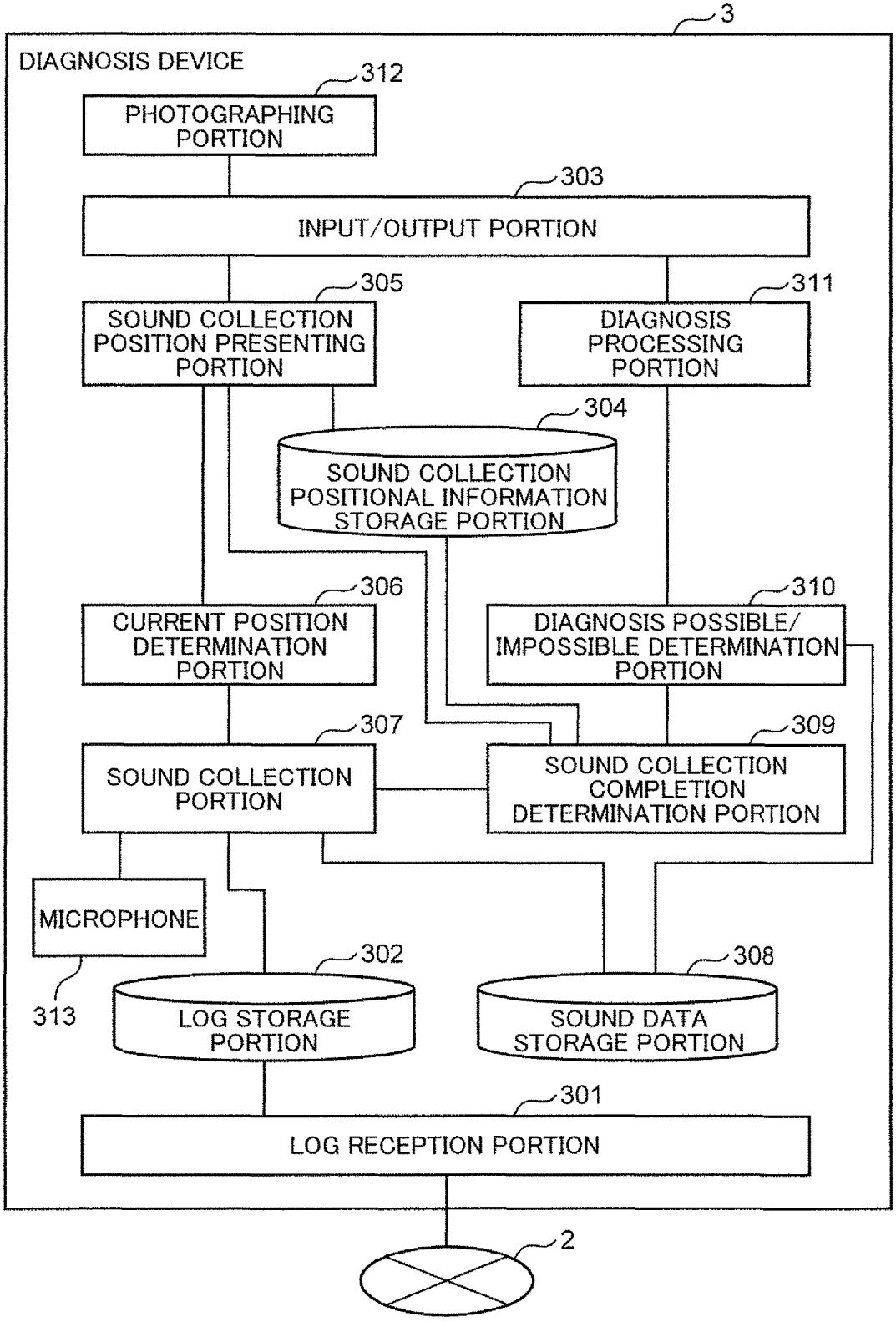
FIG. 4 is a diagram showing a configuration of a diagnosis device in the present embodiment.

FIG. 4 is a diagram showing a configuration of the diagnosis device in the present embodiment. The diagnosis device 3 includes a log reception portion 301, a log storage portion 302, an input/output portion 303, a sound collection positional information storage portion 304, a sound collection position presenting portion 305, a current position determination portion 306, a sound collection portion 307, a sound data storage portion 308, a sound collection completion determination portion 309, a diagnosis possible/impossible determination portion 310, a diagnosis processing portion 311, a photographing portion 312, and a microphone 313 as shown in FIG. 4.

A processor not shown includes the sound collection position presenting portion 305, the current position determination portion 306, the sound collection portion 307, the sound collection completion determination portion 309, the diagnosis possible/impossible determination portion 310, and the diagnosis processing portion 311, a memory not shown includes the log storage portion 302, the sound collection positional information storage portion 304, and the sound data storage portion 308, and a communication unit not shown includes the log reception portion 301. The memory is, for example, read only memory (ROM), electrically erasable programmable read only memory (EEPROM), or the like.

The log reception portion 301 receives log data from the electric apparatus 1 via the short-distance radio communication path 2. The log data includes, for example, time stamp, drive mode information, room fan operation information, and louver operation information. Then, the log reception portion 301 stores the received log data in the log storage portion 302.

The log storage portion 302 stores the log data of the electric apparatus 1.

FIG. 5 is a diagram showing one example of a data configuration of the log storage portion in the present embodiment. As shown in FIG. 5, the log storage portion 302 stores a table composed of time stamp, drive mode information, room fan operation information, and louver operation information. The log storage portion 302 may store log data for each electric apparatus 1.

The input/output portion 303, which is, for example, a touch screen, receives external (user) input, as well as displaying information for the outside (user).

The photographing portion 312, which is, for example, a camera, photographs surroundings of the diagnosis device 3 to obtain the photographed image. The photographing portion 312 outputs a photographed image to the input/output portion 303. The input/output portion 303 displays the image photographed by the photographing portion 312.

The sound collection positional information storage portion 304 stores at least two sound collection positions of an abnormal sound of the electric apparatus 1. More specifically, the sound collection positional information storage portion 304 stores a model of the electric apparatus 1, a diagnosis target part corresponding to an abnormal sound in the electric apparatus 1, and at least two sound collection positions so as to be correlated with each other.

FIG. 6 is a diagram showing one example of a data configuration of the sound collection positional information storage portion in the present embodiment. The sound collection positional information storage portion 304 stores a table composed of a model of the electric apparatus 1, a diagnosis target part, a sound collection order, a sound collection position, and sound collection time. In FIG. 6, for a model "AC1", two kinds of diagnosis target parts "room fan" and "louver" are defined, to which each diagnosis target part, N sets (N is an integer of two or more) of a sound collection order, a sound collection position, and sound collection time (unit is second) are correlated. For example, in a case where the model is "AC1", and the diagnosis target part is "room fan", it is recited that first, sound collection is conducted for 10 seconds at a first sound collection position "A", next, sound collection is conducted for 10 seconds at a second sound collection position "B", and lastly, sound collection is conducted for 10 seconds at a third sound collection position "C".

A two-dimensional code is physically printed at a position corresponding to a sound collection position on a surface of a main body of the electric apparatus 1 as a diagnosis target. In the two-dimensional code, information indicative of a sound collection position is stored, and the diagnosis device 3 obtains a sound collection position by reading the two-dimensional code.

The sound collection position presenting portion 305 obtains at least two sound collection positions from the sound collection positional information storage portion 304 and gives an instruction to present the at least two sound collection positions to the outside. The sound collection position presenting portion 305 obtains model information for specifying a model of the electric apparatus 1, and diagnosis target part information for specifying a diagnosis target part in the electric apparatus 1. The input/output portion 303 receives input of model information and diagnosis target part information by a technical staff and outputs the received model information and diagnosis target part information to the sound collection position presenting portion 305. The sound collection position presenting portion 305 obtains at least two sound collection positions correlated with the obtained model information and diagnosis target part information from the sound collection positional information storage portion 304.

When a model of the electric apparatus 1 as a diagnosis target and a diagnosis target part are input as a diagnosis request from the outside (user) via the input/output portion 303, the sound collection position presenting portion 305 obtains the N sets of a sound collection order, a sound collection position, and sound collection time corresponding to the model and the diagnosis target part from the sound collection positional information storage portion 304. Then, the sound collection position presenting portion 305 first presents the first sound collection position to the outside via the input/output portion 303. Then, the sound collection position presenting portion 305 outputs the model, the diagnosis target part, the sound collection order, the sound collection position, and the sound collection time to the current position determination portion 306. Hereafter, when a sound collection order is input from the sound collection completion determination portion 309, the sound collection position presenting portion 305 presents a sound collection position and sound collection time in the subsequent sound collection order to the outside via the input/output portion 303. Then, the sound collection position presenting portion 305 outputs the model, the diagnosis target part, the sound collection order, the sound collection position, and the sound collection time to the current position determination portion 306 in the same manner as the above.

The current position determination portion 306 compares a current position of the diagnosis device 3 and one sound collection position of the presented at least two sound collection positions. Upon receiving the model, the diagnosis target part, the sound collection order, the sound collection position, and the sound collection time from the sound collection position presenting portion 305, the current position determination portion 306 constantly confirms whether a current position of the diagnosis device 3 coincides with the sound collection position received from the sound collection position presenting portion 305.

Position specifying information for specifying at least two sound collection positions is applied to the surface of the electric apparatus 1. The position specifying information is, for example, a two-dimensional code. The current position determination portion 306 obtains an image of the electric apparatus 1 photographed by the photographing portion 312 provided in the diagnosis device 3 and displays the obtained image on the input/output portion 303 provided in the diagnosis device 3. The current position determination portion 306 determines whether the image displayed on the input/output portion 303 includes position specifying information corresponding to one sound collection position of the presented at least two sound collection positions.

A sound collection position, for example, is physically printed on the surface of the electric apparatus 1 as a two-dimensional code. The input/output portion 303 displays an image photographed by the photographing portion 312, as well as displaying a detection area of a predetermined size at the center of a screen. A technical staff moves the diagnosis device 3 such that a two-dimensional code on the photographed electric apparatus 1 is included in the detection area. The current position determination portion 306 reads the two-dimensional code in the detection area to obtain a sound collection position stored in the two-dimensional code. The current position determination portion 306 detects the two-dimensional code included in the detection area from the image obtained by the photographing portion 312 provided in the diagnosis device 3 and obtains a sound collection position stored in the two-dimensional code, thereby confirming that the current position of the diagnosis device 3 and the sound collection position received from the sound collection position presenting portion 305 coincide with each other.

A size of a detection area displayed on a display screen is set in advance according to a distance from the electric apparatus 1. Substantial coincidence of a size of a detection area and a size of a photographed two-dimensional code enables a distance and a direction from the electric apparatus 1 to the diagnosis device 3 to be fixed.

When determining that a current position of the diagnosis device 3 and a sound collection position received from the sound collection position presenting portion 305 coincide with each other, the current position determination portion 306 outputs the model, the diagnosis target part, the sound collection order, the sound collection position, and the sound collection time to the sound collection portion 307.

While in the present embodiment, a two-dimensional code is physically printed on the surface of the electric apparatus 1, the present disclosure is not particularly limited thereto, and a bar code may be physically printed on the surface of the electric apparatus 1.

The diagnosis device 3 may also in advance store an image enabling a sound collection position to be specified so as to be correlated with a sound collection position, in which the current position determination portion 306 may determine whether an image photographed by the photographing portion 312 coincides with the image stored in advance. An image which enables identification of a sound collection position is, for example, an image of the electric apparatus 1 photographed at the sound collection position. Then, when determining that a photographed image and an image stored in advance coincide with each other, the current position determination portion 306 may determine that the current position of the diagnosis device 3 and the sound collection position received from the sound collection position presenting portion 305 coincide with each other. When determining that a photographed image and an image stored in advance do not coincide with each other, the current position determination portion 306 may determine that the current position of the diagnosis device 3 and the sound collection position received from the sound collection position presenting portion 305 do not coincide with each other. This eliminates a need of physically printing a two-dimensional code on the surface of the electric apparatus 1, thereby improving design of appearance of the electric apparatus 1, and also eliminates a need of a reader in the diagnosis device 3 for reading a two-dimensional code, thereby further simplifying a configuration.

The microphone 313 obtains surrounding sound of the diagnosis device 3. While in the present embodiment, the diagnosis device 3 internally contains the microphone 313, the present disclosure is not particularly limited thereto, and the diagnosis device 3 may be connected with an externally attached microphone 313 via an external terminal.

The sound collection portion 307 obtains sound data indicative of an abnormal sound of the electric apparatus 1 collected by the microphone 313, based on a comparison result of the current position determination portion 306, and stores the obtained sound data in the sound data storage portion 308 so as to correlated with log data obtained from the electric apparatus 1 and one sound collection position. After obtaining sound data of the electric apparatus 1 indicative of an abnormal sound, the sound collection portion 307 obtains log data from the log storage portion 302.

The sound collection portion 307 receives the model, the diagnosis target part, the sound collection order, the sound collection position, and the sound collection time from the current position determination portion 306. Then, the sound collection portion 307 presents sound collection time to the outside via the input/output portion 303. Thereafter, using the microphone 313 mounted on the diagnosis device 3, the sound collection portion 307 collects sound for a period of the received sound collection time. Upon completion of the sound collection, the sound collection portion 307 obtains log data including drive mode information, room fan operation information, and louver operation information from the log storage portion 302. Thereafter, the sound collection portion 307 stores the sound collection order, the sound collection position, the drive mode information, the room fan operation information, the louver operation information, and sound data in the sound data storage portion 308. After the storage, the sound collection portion 307 outputs the model, the diagnosis target part, and sound collection order to the sound collection completion determination portion 309.

The sound data storage portion 308 stores at least two items of sound data, at least two items of log data of the electric apparatus 1, and at least two sound collection positions so as to be correlated with each other.

FIG. 7 is a diagram showing one example of a data configuration of the sound data storage portion in the present embodiment, and FIG. 8 is a diagram showing another example of a data configuration of the sound data storage portion in the present embodiment. As shown in FIG. 7 and FIG. 8, the sound data storage portion 308 stores a table composed of N sets (N is an integer of two or more) of a sound collection order, a sound collection position, drive mode information, room fan operation information, louver operation information, and sound data. The drive mode information, the room fan operation information, and the louver operation information are examples of log data.

The sound collection completion determination portion 309 determines whether sound collection at the presented at least two sound collection positions is completed. The sound collection completion determination portion 309 receives the model, the diagnosis target part, and the sound collection order from the sound collection portion 307. Then, the sound collection completion determination portion 309 accesses the sound collection positional information storage portion 304 to determine whether the received sound collection order falls on the last in the sound collection order at the diagnosis target part. Unless the received sound collection order is the sound collection order falling on the last at the diagnosis target part, the sound collection completion determination portion 309 obtains a subsequent sound collection order and outputs the same to the sound collection position presenting portion 305. When the received sound collection order is the last in the sound collection order at the diagnosis target part, the sound collection completion determination portion 309 outputs a sound collection completion signal to the diagnosis possible/impossible determination portion 310.

The diagnosis possible/impossible determination portion 310 determines whether diagnosis of an abnormal sound of the electric apparatus 1 is possible, based on at least two items of log data correlated with at least two items of sound data stored in the sound data storage portion 308. After determining that sound collection is all completed at at least two sound collection positions, the diagnosis possible/impossible determination portion 310 determines whether diagnosis of an abnormal sound of the electric apparatus 1 is possible. When receiving a sound collection completion signal from the sound collection completion determination portion 309, the diagnosis possible/impossible determination portion 310 determines whether diagnosis of an abnormal sound is possible using collected sound data, based on the log data stored in the sound data storage portion 308.

Specifically, the diagnosis possible/impossible determination portion 310 confirms whether log data associated with a diagnosis target part has a change during sound collection at a plurality of sound collection positions. In a case where predetermined items of at least two items of log data are all identical to each other, the diagnosis possible/impossible determination portion 310 determines that diagnosis of an abnormal sound of the electric apparatus 1 is possible.

In a case, for example, where a diagnosis target part is "room fan", the diagnosis possible/impossible determination portion 310 determines whether a plurality of drive mode information and a plurality of room fan operation information have changed (have been identical to each other) during sound collection at a plurality of sound collection positions. In a case where the plurality of drive mode information and the plurality of room fan operation information are all identical to each other, the diagnosis possible/impossible determination portion 310 determines that diagnosis of an abnormal sound of the electric apparatus 1 is possible. In a case where the sound data storage portion 308 stores the log data shown in FIG. 7, since drive mode information and room fan operation information are all identical to each other, the diagnosis possible/impossible determination portion 310 determines that diagnosis of an abnormal sound of the electric apparatus 1 is possible and outputs a diagnosis allowance signal to the diagnosis processing portion 311. By contrast, in a case where the sound data storage portion 308 stores the log data shown in FIG. 8, since drive mode information and room fan operation information are not identical to each other, the diagnosis possible/impossible determination portion 310 determines that diagnosis of an abnormal sound of the electric apparatus 1 is impossible to output a first diagnosis order to the sound collection position presenting portion 305 and instruct the same to present a sound collection position again.

The diagnosis processing portion 311 diagnoses an abnormal sound of the electric apparatus 1 by using at least two items of sound data and at least two sound collection positions correlated with the at least two items of sound data which are stored in the sound data storage portion 308, based on a determination result whether sound collection is completed and a determination result whether diagnosis of an abnormal sound is possible. At this time, the diagnosis processing portion 311 emphasizes an abnormal sound of the electric apparatus 1 using at least two items of sound data and at least two sound collection positions stored in the sound data storage portion 308, and diagnoses the emphasized abnormal sound.

Upon receiving a diagnosis allowance signal from the diagnosis possible/impossible determination portion 310, the diagnosis processing portion 311 obtains all the sound collection positions and all the sound data from the sound data storage portion 308. Then, the diagnosis processing portion 311 selects a filter corresponding to each sound collection position using a plurality of sound collection positions and a plurality of sound data to conduct filter processing with respect to a plurality of sound data collected by the microphone 313. The filter processing removes noise to emphasize an abnormal sound from a target sound source. The diagnosis processing portion 311 generates, from a plurality of sound data, one sound data obtained by emphasizing an abnormal sound from a target sound source. A specific emphasis method is recited in Japanese Unexamined Patent Application Publication No. 2006-60720 and therefore detailed description thereof will be omitted. For the processing of emphasizing only a sound from a target sound source from among a plurality of sound data, a known technique is used.

Then, the diagnosis processing portion 311 diagnoses an abnormal sound from an emphasized target sound source. The diagnosis processing portion 311 diagnoses whether a diagnosis target part of the electric apparatus 1 fails from sound data of the abnormal sound. For processing of diagnosing whether the electric apparatus 1 fails from sound data of an abnormal sound, a known technique, such as the technique recited in PCT International Publication No. 2015/068446 is used.

While in the present embodiment, at least two items of sound data is obtained which is collected at at least two sound collection positions for emphasizing an operating sound of the electric apparatus 1, the present disclosure is not particularly limited thereto, and the diagnosis processing portion 311 may diagnose whether each of at least two sound collection positions fails using at least two items of sound data.

The diagnosis processing portion 311 diagnoses an abnormal sound and gives an instruction to present a diagnosis result. The diagnosis processing portion 311 outputs a diagnosis result to the outside via the input/output portion 303.

A part of the configuration of the diagnosis device 3 may be provided in a server communicably connected to the diagnosis device 3 via a network. For example, the log reception portion 301, the log storage portion 302, the sound collection positional information storage portion 304, the sound collection position presenting portion 305, the current position determination portion 306, the sound collection portion 307, the sound data storage portion 308, the sound collection completion determination portion 309, the diagnosis possible/impossible determination portion 310, and the diagnosis processing portion 311 may be provided in the server.

Detailed operation of each of the electric apparatus 1 and the diagnosis device 3 will be described in the following.

Operation of the diagnosis device 3 will be described with respect to an example of a screen displayed on the diagnosis device 3.

Figure 9:
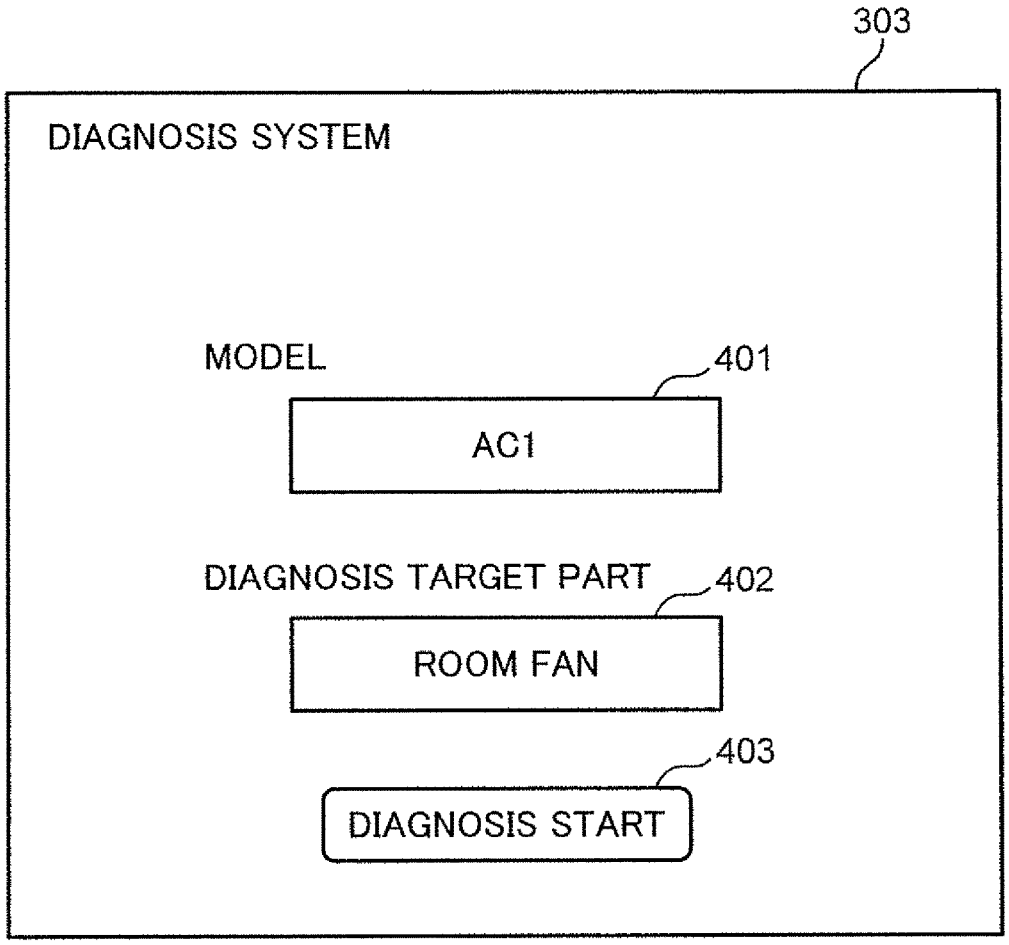
FIG. 9 is a diagram showing one example of a diagnosis start reception screen displayed on the diagnosis device in the present embodiment.

FIG. 9 is a diagram showing one example of a diagnosis start reception screen displayed on the diagnosis device in the present embodiment.

First, the input/output portion 303 of the diagnosis device 3 receives a model of the electric apparatus 1 and a diagnosis target part selected by a technical staff, as well as displaying the diagnosis start reception screen for receiving an instruction to start diagnosis by the technical staff. The diagnosis start reception screen shown in FIG. 9 includes an input field 401 for inputting a model of the electric apparatus 1, an input field 402 for inputting a diagnosis target part, and a diagnosis start button 403 for giving an instruction to start diagnosis. The technical staff inputs a model of the electric apparatus 1 as a diagnosis target to the input field 401 and inputs a diagnosis target part in the electric apparatus 1 to the input field 402 to press the diagnosis start button 403. This starts the diagnosis processing.

Figure 10:
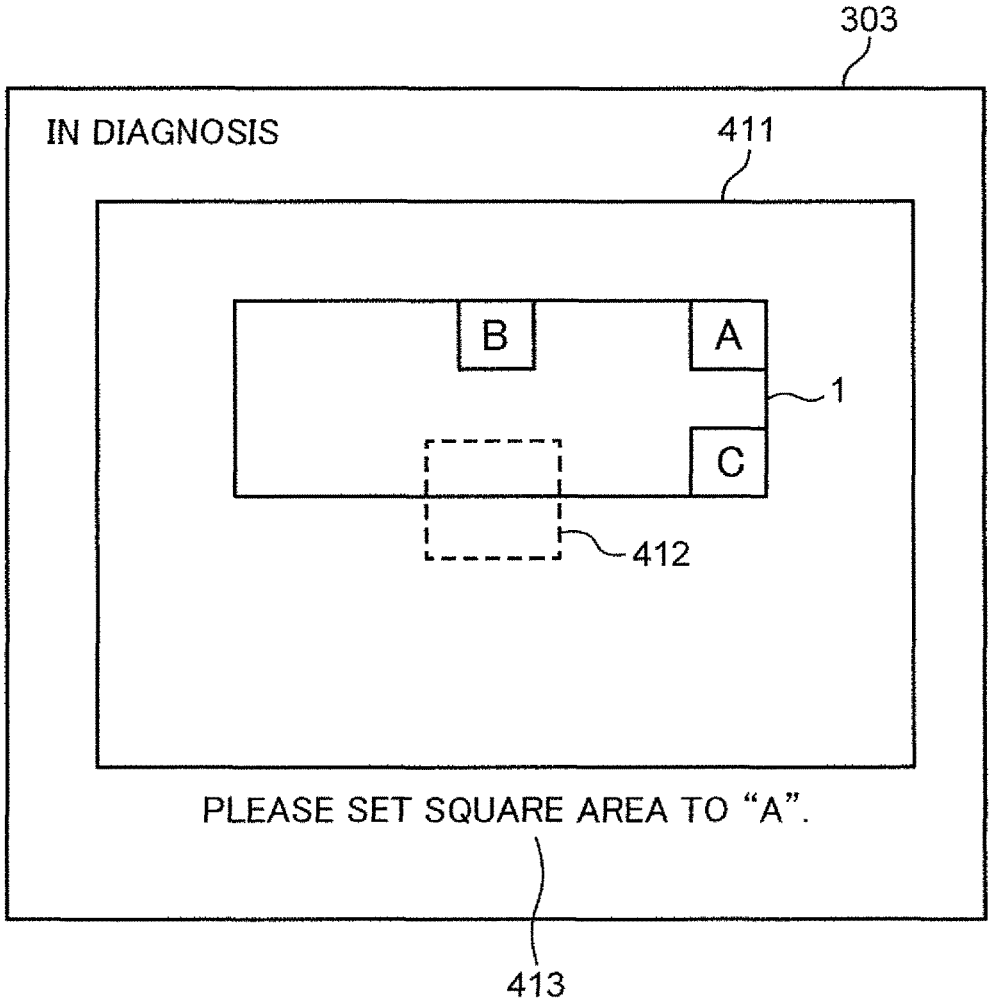
FIG. 10 is a diagram showing one example of a diagnosis screen displayed on the diagnosis device when a sound collection position is presented in the present embodiment.

When the diagnosis start button 403 is pressed on the diagnosis start reception screen, the input/output portion 303 displays a diagnosis screen shown in FIG. 10.

FIG. 10 is a diagram showing one example of a diagnosis screen displayed on the diagnosis device when a sound collection position is presented in the present embodiment. In FIG. 10, there are displayed, on the diagnosis screen, a screen image 411 being photographed by the photographing portion 312, a detection area 412 indicative of an area on the screen where a two-dimensional code can be detected, and a message 413 for guiding the detection area 412 to be set to a two-dimensional code indicative of the first sound collection position A. In the description of FIG. 10 to FIG. 18, the sound collection position presenting portion 305 obtains the first sound collection position, the second sound collection position, and the third sound collection position as at least two sound collection positions corresponding to the electric apparatus 1. While in practice, two-dimensional codes indicative of the first to third sound collection positions are printed on the surface of the electric apparatus 1, two-dimensional codes indicative of the first to third sound collection positions are represented as letters "A" to "C" in the description of FIG. 10 to FIG. 18.

The technical staff moves the diagnosis device 3 such that the two-dimensional code indicative of the first sound collection position A on the surface of the electric apparatus 1 overlaps the detection area 412 on the screen.

Figure 11:
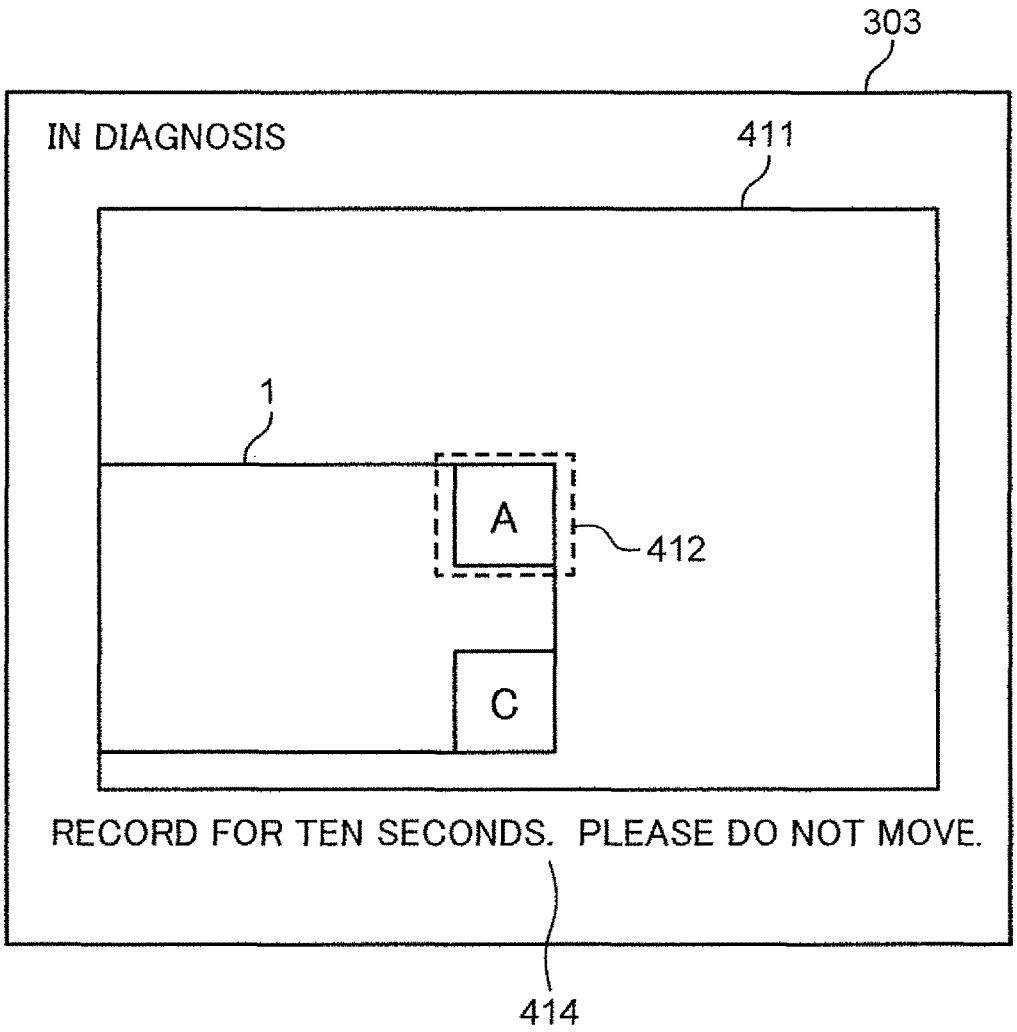
FIG. 11 is a diagram showing one example of a diagnosis screen displayed on the diagnosis device when a current position of the diagnosis device and a presented first sound collection position are compared in the present embodiment.

In a case where the first sound collection position A on the surface of the electric apparatus 1 overlaps the detection area 412 on the screen, so that the first sound collection position A stored in the two-dimensional code within the detection area 412 is read by the current position determination portion 306, the input/output portion 303 displays a diagnosis screen shown in FIG. 11.

FIG. 11 is a diagram showing one example of a diagnosis screen displayed on the diagnosis device when a current position of the diagnosis device and a first sound collection position presented are compared in the present embodiment. In FIG. 11, there are displayed, on the diagnosis screen, the screen image 411 being photographed by the photographing portion 312, the detection area 412, and a message 414 for giving an instruction to set the detection area 412 to a two-dimensional code indicative of the first sound collection position A until a predetermined sound collection time elapses. The predetermined sound collection time is, for example, 10 seconds.

The technical staff moves the diagnosis device 3 such that an outer edge of the detection area 412 and an outer edge of the two-dimensional code coincide with each other. In a case where a two-dimensional code in the detection area 412 is read, the current position of the diagnosis device 3 is considered to coincide with the first sound collection position A.

The technical staff stops movement of the diagnosis device 3 in a state where the detection area 412 and the two-dimensional code indicative of the first sound collection position A overlap with each other. Then, the sound collection portion 307 obtains sound data indicative of an abnormal sound of the electric apparatus 1 collected by the microphone 313 until the predetermined sound collection time elapses.

Figure 12:
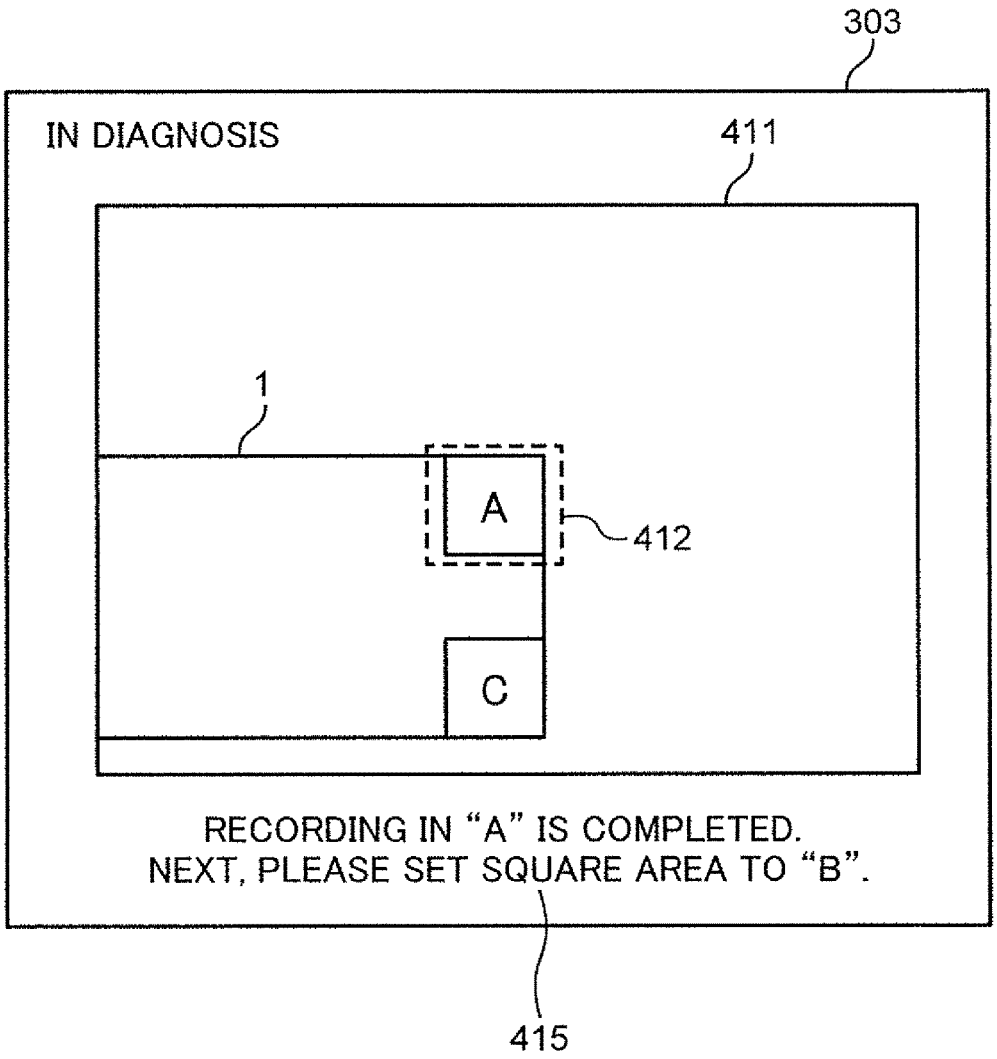
FIG. 12 is a diagram showing one example of a diagnosis screen displayed on the diagnosis device upon completion of sound collection at the presented first sound collection position in the present embodiment.

When the predetermined sound collection time elapses to complete the sound collection at the first sound collection position A, the input/output portion 303 displays a diagnosis screen shown in FIG. 12.

FIG. 12 is a diagram showing one example of a diagnosis screen displayed on the diagnosis device upon completion of sound collection at the presented first sound collection position in the present embodiment. In FIG. 12, there are displayed, on the diagnosis screen, the screen image 411 being photographed by the photographing portion 312, the detection area 412, and a message 415 which notifies completion of sound collection at the first sound collection position A and guides the detection area 412 to be set to a two-dimensional code indicative of the second sound collection position B.

Upon confirming that the sound collection at the first sound collection position A is completed, the technical staff moves the diagnosis device 3 such that the two-dimensional code indicative of the second sound collection position B on the surface of the electric apparatus 1 overlaps the detection area 412 on the screen.

Figure 13:
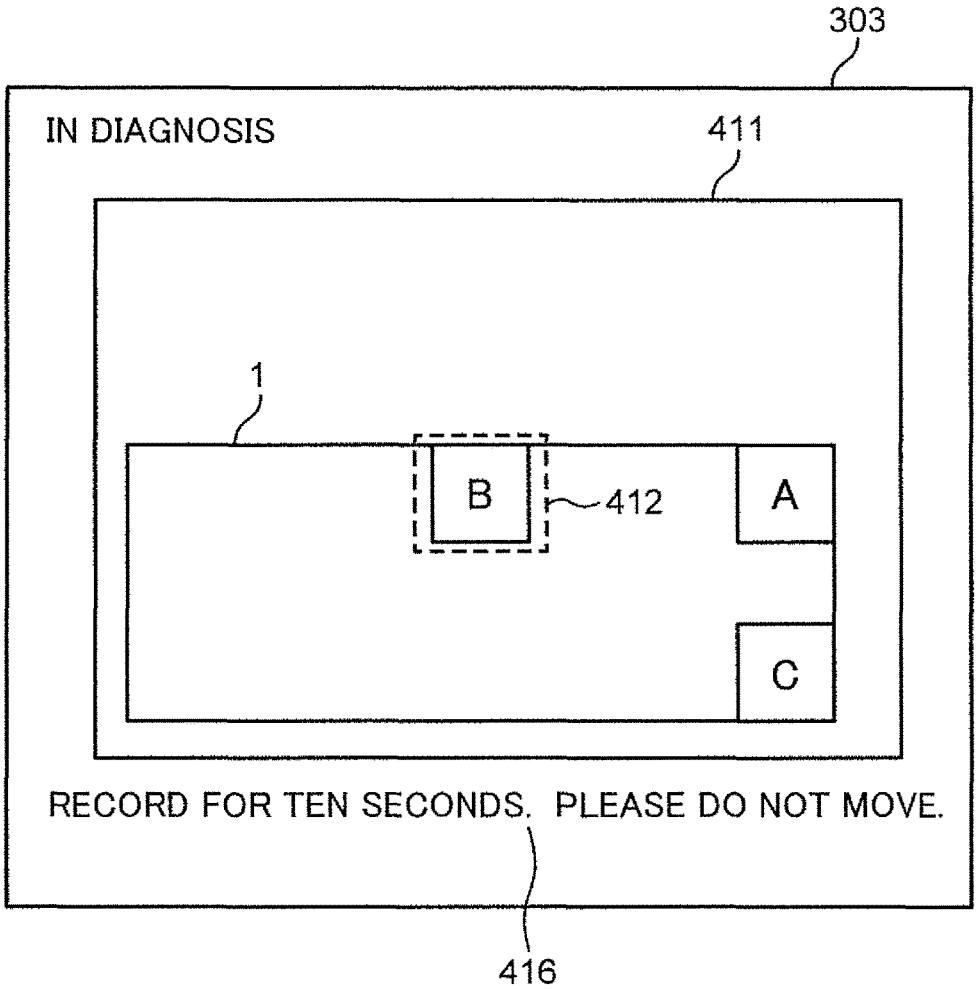
FIG. 13 is a diagram showing one example of a diagnosis screen displayed on the diagnosis device when a current position of the diagnosis device and a presented second sound collection position are compared in the present embodiment.

When the two-dimensional code indicative of the second sound collection position B on the surface of the electric apparatus 1 overlaps the detection area 412 on the screen, and the second sound collection position B stored in the two-dimensional code within the detection area 412 is read by the current position determination portion 306, the input/output portion 303 displays a diagnosis screen shown in FIG. 13.

FIG. 13 is a diagram showing one example of a diagnosis screen displayed on the diagnosis device when a current position of the diagnosis device and a second sound collection position presented are compared in the present embodiment. In FIG. 13, there are displayed, on the diagnosis screen, the screen image 411 being photographed by the photographing portion 312, the detection area 412, and a message 416 for giving an instruction to set the detection area 412 to a two-dimensional code indicative of the second sound collection position B until a predetermined sound collection time elapses. The predetermined sound collection time is, for example, 10 seconds.

The technical staff stops movement of the diagnosis device 3 in a state where the detection area 412 and the two-dimensional code indicative of the second sound collection position B overlap with each other. Then, the sound collection portion 307 obtains sound data indicative of an abnormal sound of the electric apparatus 1 collected by the microphone 313 until the predetermined sound collection time elapses.

Figure 14:
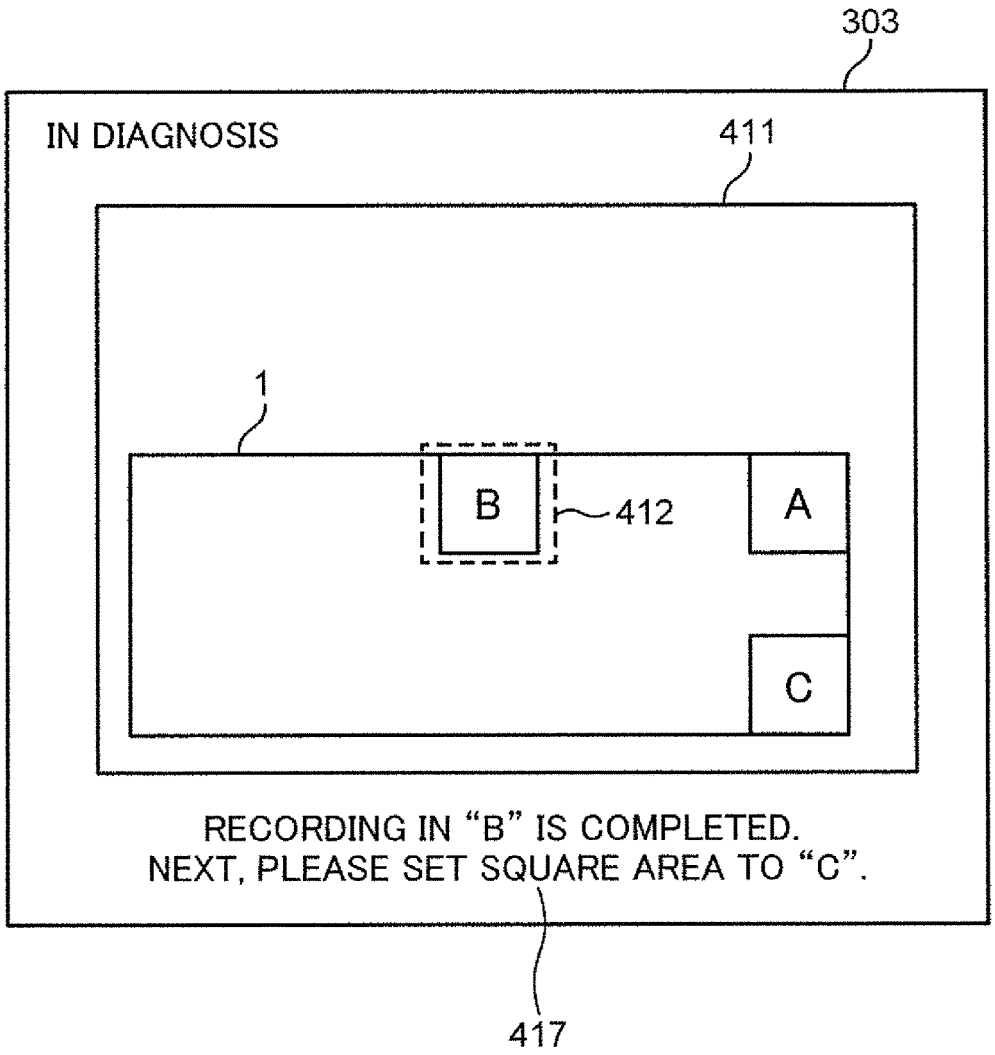
FIG. 14 is a diagram showing one example of a diagnosis screen displayed on the diagnosis device upon completion of sound collection at the presented second sound collection position in the present embodiment.

When the predetermined sound collection time elapses to complete the sound collection at the second sound collection position B, the input/output portion 303 displays a diagnosis screen shown in FIG. 14.

FIG. 14 is a diagram showing one example of a diagnosis screen displayed on the diagnosis device upon completion of sound collection at the presented second sound collection position in the present embodiment. In FIG. 14, there are displayed, on the diagnosis screen, the screen image 411 being photographed by the photographing portion 312, the detection area 412, and a message 417 which notifies completion of sound collection at the second sound collection position B and guides the detection area 412 to be set to a two-dimensional code indicative of the third sound collection position C.

Upon confirming that the sound collection at the second sound collection position B is completed, the technical staff moves the diagnosis device 3 such that the two-dimensional code indicative of the third sound collection position C on the surface of the electric apparatus 1 overlaps the detection area 412 on the screen.

Figure 15:
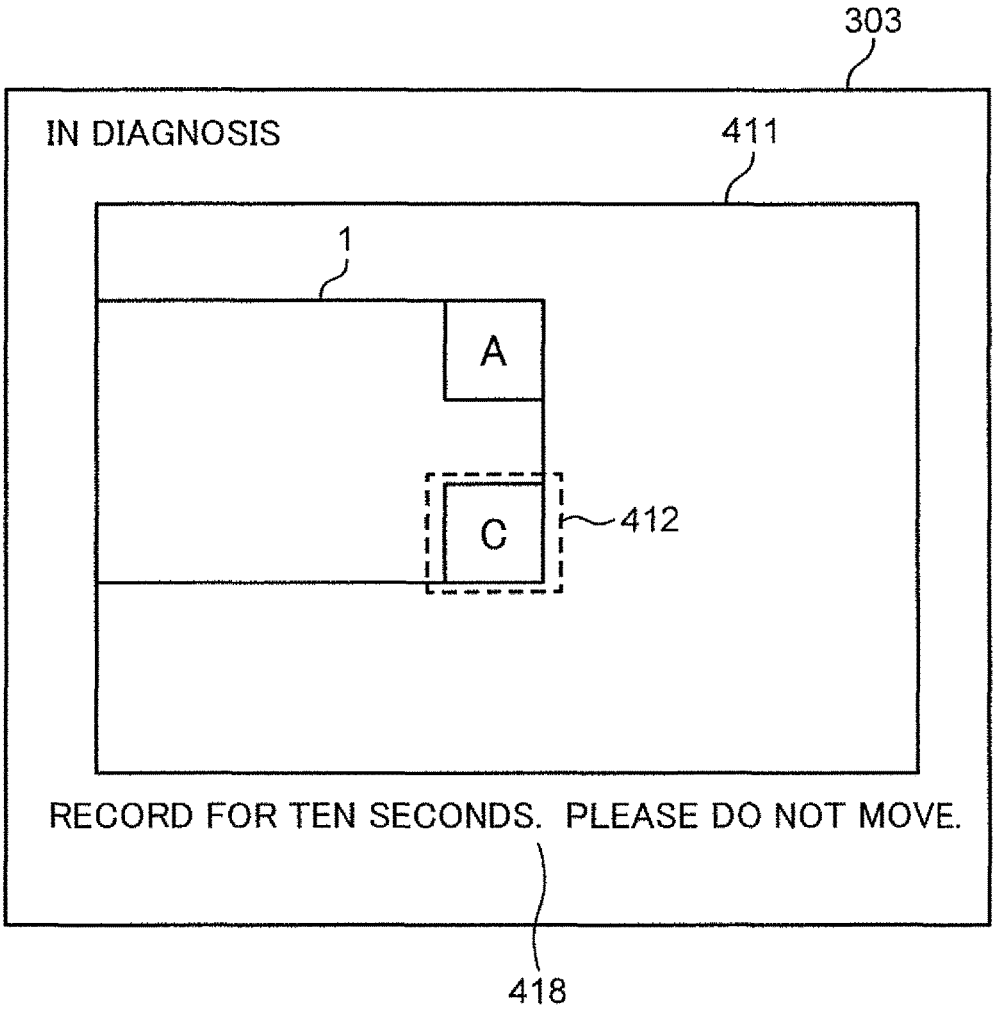
FIG. 15 is a diagram showing one example of a diagnosis screen displayed on the diagnosis device when a current position of the diagnosis device and a presented third sound collection position are compared in the present embodiment.

When the two-dimensional code indicative of the third sound collection position C on the surface of the electric apparatus 1 overlaps the detection area 412 on the screen, and the third sound collection position C stored in the two-dimensional code within the detection area 412 is read by the current position determination portion 306, the input/output portion 303 displays a diagnosis screen shown in FIG. 15.

FIG. 15 is a diagram showing one example of a diagnosis screen displayed on the diagnosis device when a current position of the diagnosis device and a third sound collection position presented are compared in the present embodiment. In FIG. 15, there are displayed, on the diagnosis screen, the screen image 411 being photographed by the photographing portion 312, the detection area 412, and a message 418 for giving an instruction to set the detection area 412 to a two-dimensional code indicative of the third sound collection position C until a predetermined sound collection time elapses. The predetermined sound collection time is, for example, 10 seconds.

The technical staff stops movement of the diagnosis device 3 in a state where the detection area 412 and the two-dimensional code indicative of the third sound collection position C overlap with each other. Then, the sound collection portion 307 obtains sound data indicative of an abnormal sound of the electric apparatus 1 collected by the microphone 313 until the predetermined sound collection time elapses.

Figure 16:
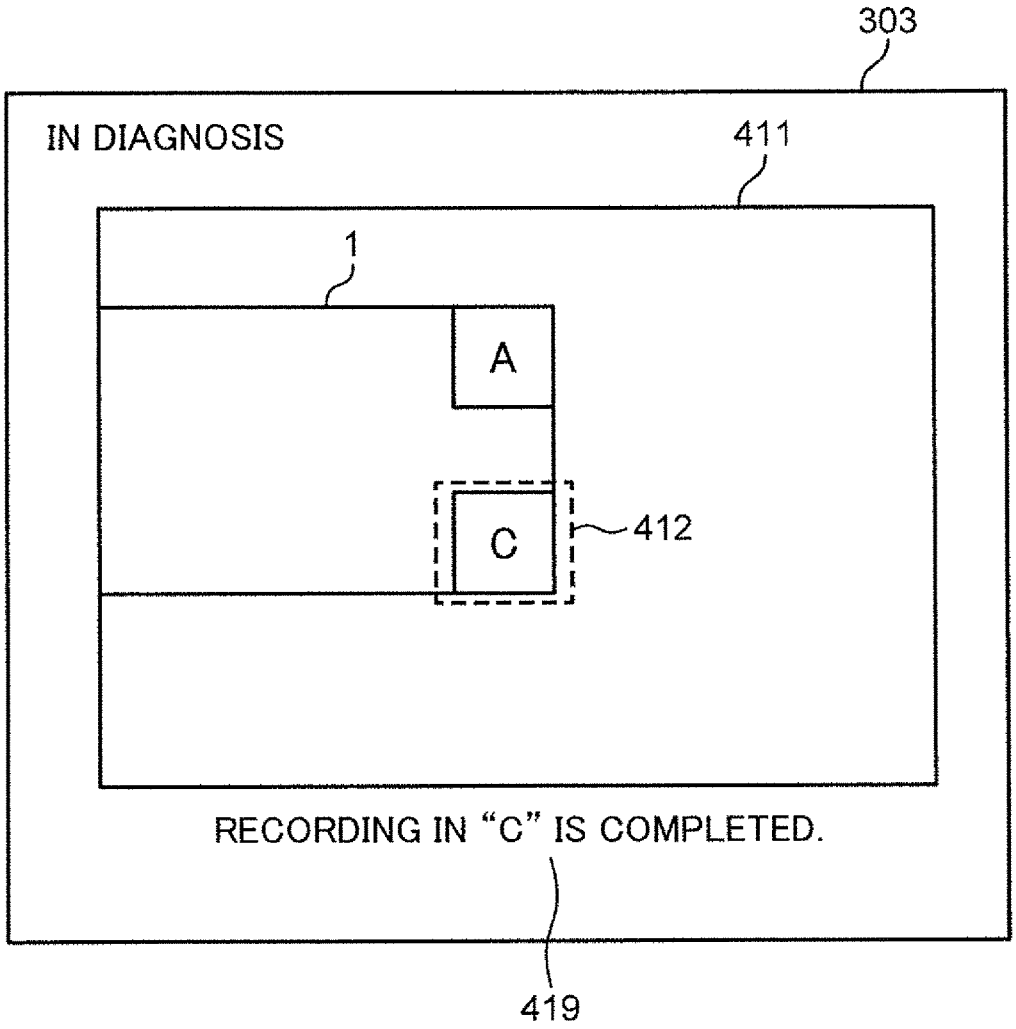
FIG. 16 is a diagram showing one example of a diagnosis screen displayed on the diagnosis device upon completion of sound collection at the presented third sound collection position in the present embodiment.

When the predetermined sound collection time elapses to complete the sound collection at the third sound collection position C, the input/output portion 303 displays a diagnosis screen shown in FIG. 16.

FIG. 16 is a diagram showing one example of a diagnosis screen displayed on the diagnosis device upon completion of sound collection at the presented third sound collection position in the present embodiment. In FIG. 16, there are displayed, on the diagnosis screen, the screen image 411 being photographed by the photographing portion 312, the detection area 412, and a message 419 which notifies completion of sound collection at the third sound collection position C.

Next, the sound collection completion determination portion 309 determines whether sound collection at the first to third sound collection positions is completed. In a case where determination is made that sound collection at the first to third sound collection positions is completed, the diagnosis possible/impossible determination portion 310 determines whether diagnosis of an abnormal sound of the electric apparatus 1 is possible, based on three items of log data correlated with three items of sound data.

In a case where determination is made that diagnosis of an abnormal sound of the electric apparatus 1 is possible, the diagnosis processing portion 311 diagnoses an abnormal sound of the electric apparatus 1 using the three items of sound data and three sound collection positions correlated with the three items of sound data which are stored in the sound data storage portion 308.

Figure 17:
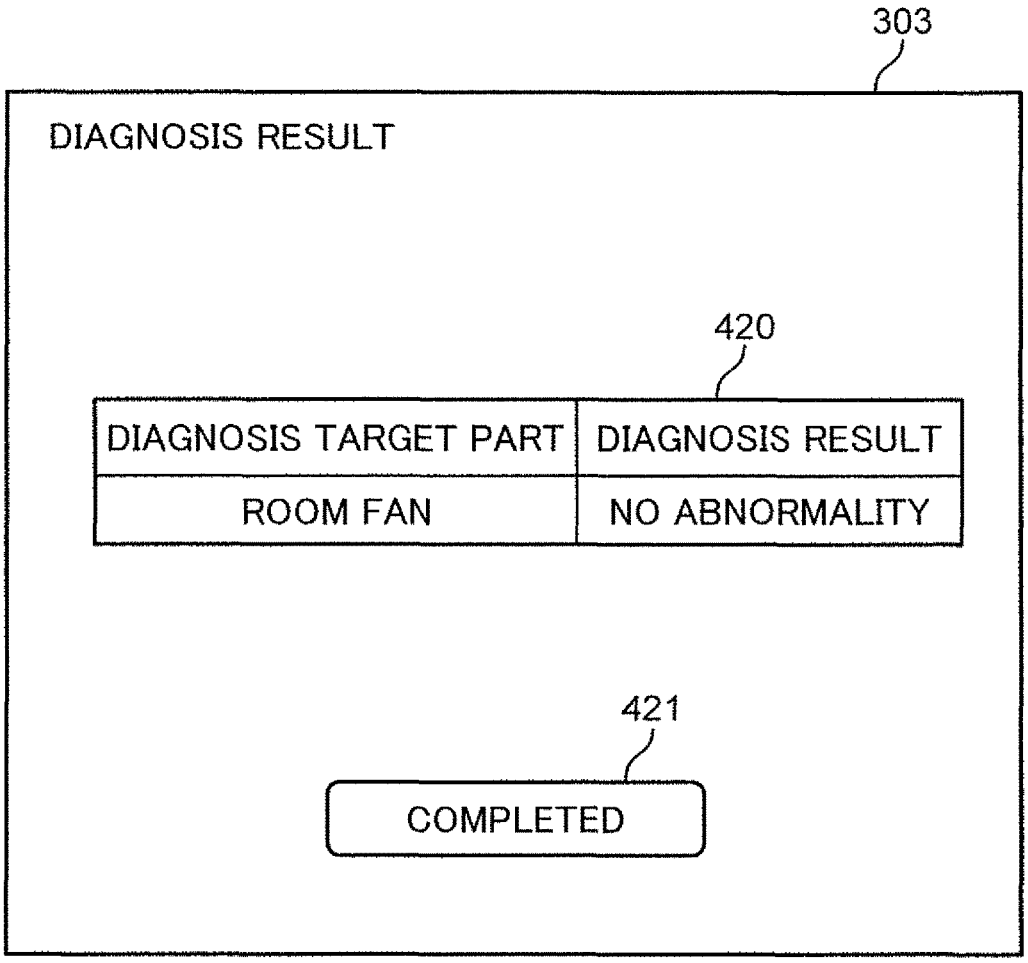
FIG. 17 is a diagram showing one example of a diagnosis result screen displayed on the diagnosis device when a diagnosis result of an abnormal sound is presented in the present embodiment.

Upon completion of the diagnosis of an abnormal sound, the input/output portion 303 displays a diagnosis result screen shown in FIG. 17.

FIG. 17 is a diagram showing one example of a diagnosis screen displayed on the diagnosis device upon presenting a diagnosis result of an abnormal sound in the present embodiment. In FIG. 17, a diagnosis result 420 of a diagnosis target part and a diagnosis completion button 421 for giving an instruction to complete diagnosis are displayed on the diagnosis result screen. The technical staff confirms the diagnosis result and presses the diagnosis completion button 421. As a result, the diagnosis processing ends.

Figure 18:
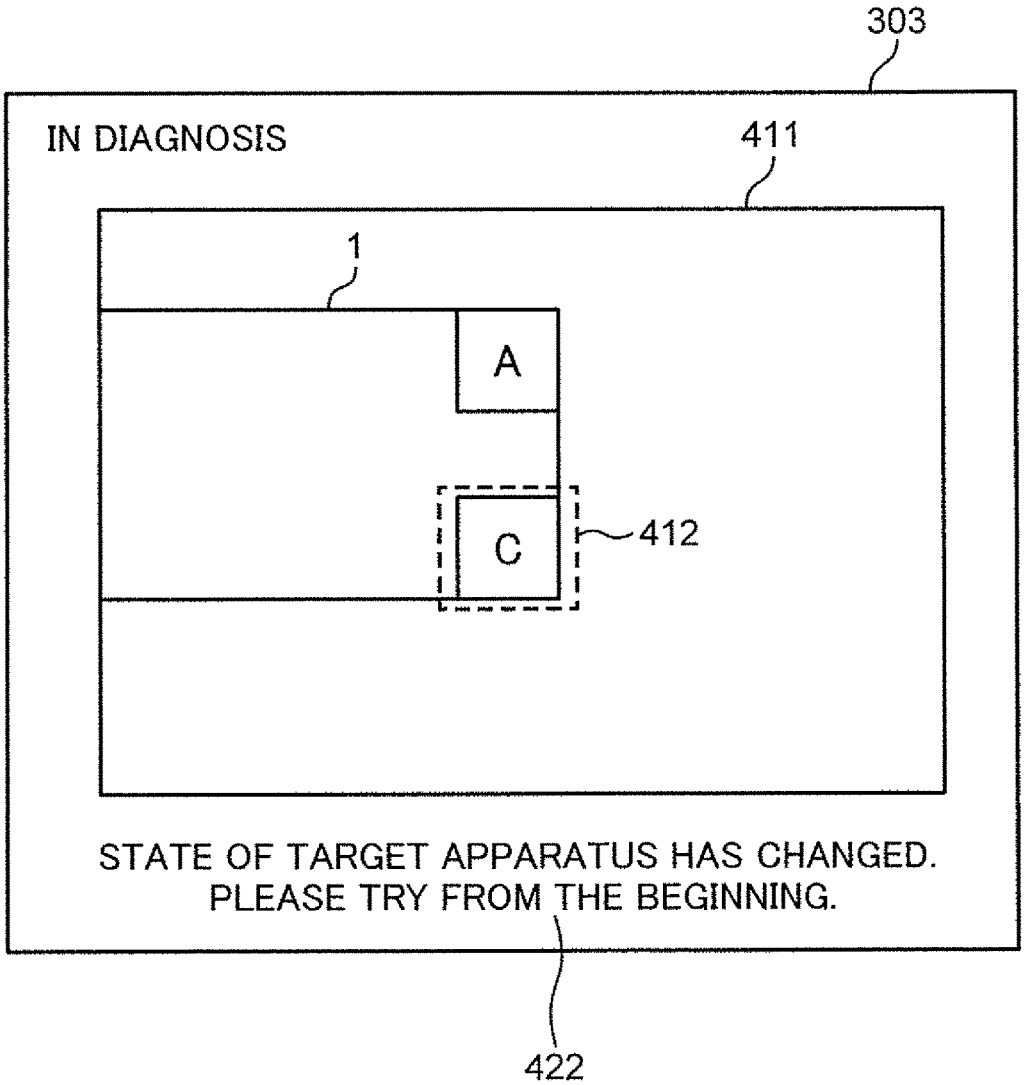
FIG. 18 is a diagram showing one example of a diagnosis screen displayed on the diagnosis device when determination that diagnosis of an abnormal sound is impossible is made after completion of sound collection in the present embodiment.

By contrast, in a case where it is determined that diagnosis of an abnormal sound of the electric apparatus 1 is impossible, the input/output portion 303 displays a diagnosis screen shown in FIG. 18.

FIG. 18 is a diagram showing one example of a diagnosis screen displayed on the diagnosis device upon determination that diagnosis of an abnormal sound is impossible after completion of sound collection in the present embodiment. In FIG. 18, there are displayed, on the diagnosis screen, the screen image 411 being photographed by the photographing portion 312, the detection area 412, and a message 422 which notifies that diagnosis of an abnormal sound of the electric apparatus 1 is impossible and guides to again collect sound starting with the first sound collection position A. In FIG. 18, since the state of the electric apparatus 1 has changed during sound collection at the first to third sound collection positions, it is notified that diagnosis of an abnormal sound of the electric apparatus 1 becomes impossible.

After the diagnosis screen shown in FIG. 18 is displayed, the input/output portion 303 again displays the diagnosis screen shown in FIG. 10. Then, sound collection at the first to third sound collection positions is again conducted.

Subsequently, operation of the electric apparatus 1 and the diagnosis device 3 will be described with reference to the flow charts shown in FIG. 19, FIG. 20, and FIG. 21.

Figure 19:
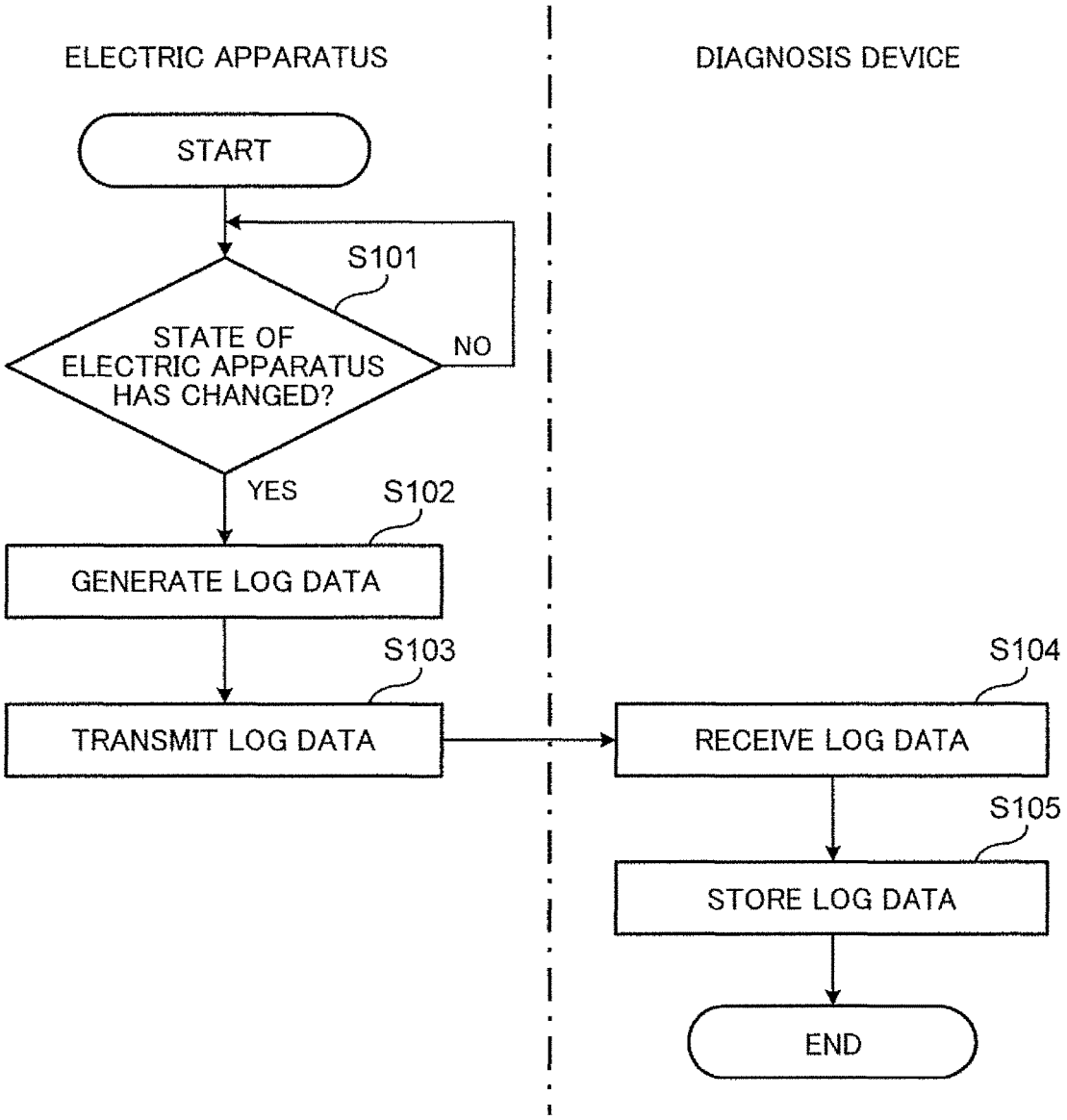
FIG. 19 is a flow chart for describing operation of log transmission processing by the electric apparatus and operation of log reception processing by the diagnosis device in the present embodiment.

FIG. 19 is a flow chart for describing operation of log transmission processing by the electric apparatus and operation of log reception processing by the diagnosis device in the present embodiment. The log transmission processing and the log reception processing are constantly conducted while diagnosis of an abnormal sound is conducted by the diagnosis device 3.

First, the log acquisition unit 102 of the electric apparatus 1 determines whether a state of the electric apparatus 1 has changed in course of control by the control unit 101 (step S101). Here, in a case where determination is made that the state of the electric apparatus 1 has not changed (NO in step S101), the determination processing of step S101 will be repeated until the state of the electric apparatus 1 changes.

By contrast, in a case where determination is made that the state of the electric apparatus 1 has changed (YES in step S101), the log acquisition unit 102 generates log data (step S102). The log acquisition unit 102 outputs the generated log data to the log transmission unit 103.

Next, the log transmission unit 103 transmits the log data obtained from the log acquisition unit 102 to the diagnosis device 3 via the short-distance radio communication path 2 (step S103).

Next, the log reception portion 301 of the diagnosis device 3 receives the log data transmitted by the electric apparatus 1 via the short-distance radio communication path 2 (step S104). The log data includes, for example, time stamp, drive mode information, room fan operation information, and louver operation information.

Next, the log reception portion 301 stores the received log data in the log storage portion 302 (step S105).

While in the present embodiment, when the state of the electric apparatus 1 changes, log data is generated and transmitted, the present disclosure is not limited thereto. In a case where determination is made that the state of the electric apparatus 1 has changed, the log acquisition unit 102 may generate log data and store the generated log data in the memory. Then, the log transmission unit 103 may transmit the log data stored in the memory to the diagnosis device 3 every predetermined time. In this case, log data accumulated in the memory before predetermined time elapses is collectively transmitted to the diagnosis device 3.

The diagnosis device 3 may also request the electric apparatus 1 to transmit log data, and the electric apparatus 1 may transmit log data in response to a request from the diagnosis device 3. In this case, after obtaining sound data, the sound collection portion 307 requests the electric apparatus 1 to transmit log data.

Figure 20:
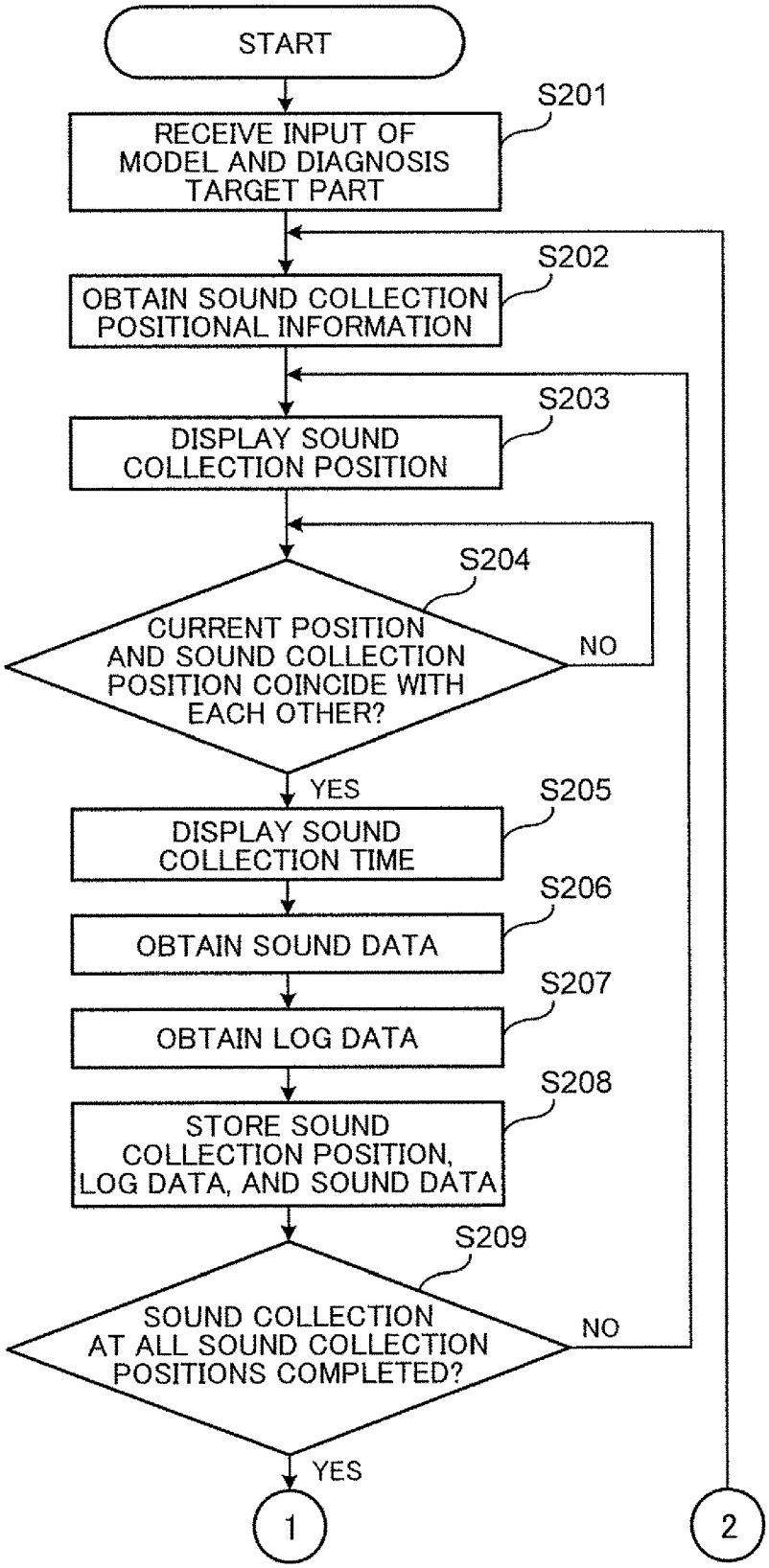
FIG. 20 is a first flow chart for describing operation of diagnosis processing by the diagnosis device in the present embodiment.
Figure 21:
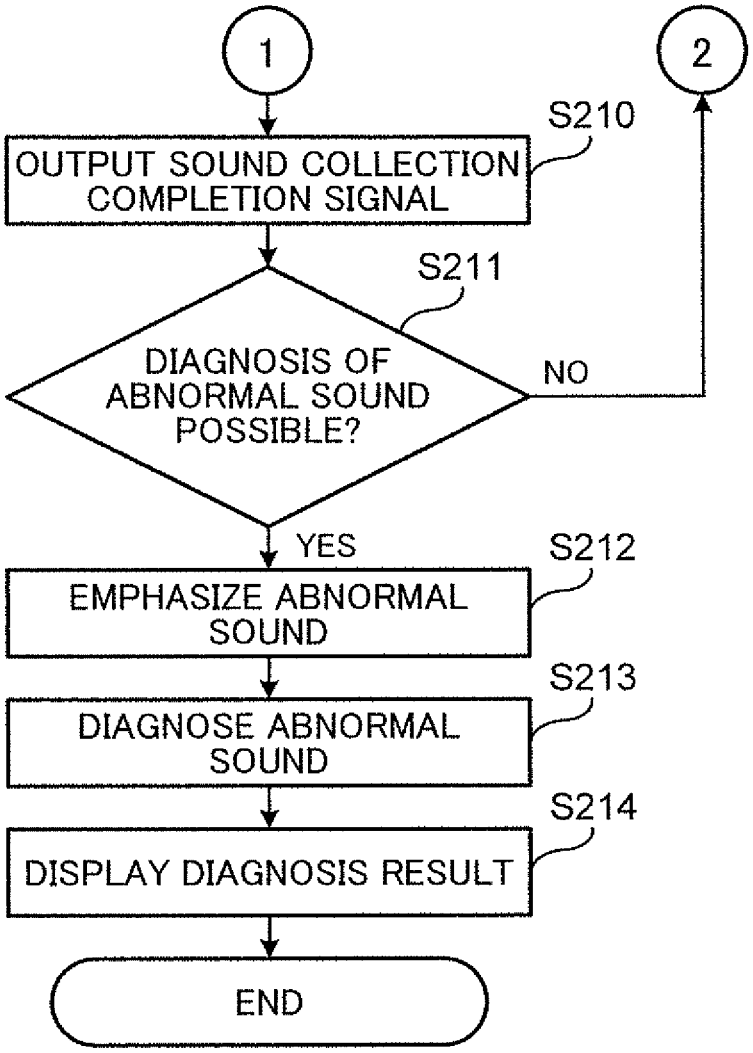
FIG. 21 is a second flow chart for describing operation of the diagnosis processing by the diagnosis device in the present embodiment.

FIG. 20 is a first flow chart for describing operation of the diagnosis processing by the diagnosis device in the present embodiment, and FIG. 21 is a second flow chart for describing operation of the diagnosis processing by the diagnosis device in the present embodiment.

First, the input/output portion 303 receives input of a model of the electric apparatus 1 as a diagnosis target and a diagnosis target part by a technical staff (step S201).

Next, the sound collection position presenting portion 305 of the diagnosis device 3 obtains sound collection positional information corresponding to the input model and diagnosis target part from the sound collection positional information storage portion 304 (step S202). The sound collection positional information includes N sets of a sound collection order, a sound collection position, and sound collection time.

Next, the sound collection position presenting portion 305 causes the input/output portion 303 to display a sound collection position which falls on the first in the sound collection order (step S203). The sound collection position presenting portion 305 instructs the input/output portion 303 to present the sound collection position falling on the first in the sound collection order to the outside, so that the input/output portion 303 presents the sound collection position falling on the first in the sound collection order to the outside. The sound collection position presenting portion 305 outputs the model, the diagnosis target part, the sound collection order, the sound collection position, and the sound collection time to the current position determination portion 306. The current position determination portion 306 receives the model, the diagnosis target part, the sound collection order, the sound collection position, and the sound collection time from the sound collection position presenting portion 305.

Next, the current position determination portion 306 determines whether the current position of the diagnosis device 3 coincides with the sound collection position received from the sound collection position presenting portion 305 (step S204). Here, in a case where determination is made that the current position does not coincide with the sound collection position (NO in step S204), the determination processing of step S204 will be repeated until determination is made that the current position coincides with the sound collection position.

By contrast, in a case where the determination is made that the current position coincides with the sound collection position (YES in step S204), the sound collection portion 307 receives the model, the diagnosis target part, the sound collection order, the sound collection position, and the sound collection time from the current position determination portion 306 to cause the input/output portion 303 to display sound collection time (step S205). The sound collection portion 307 instructs the input/output portion 303 to present sound collection time corresponding to the sound collection position falling on the first in the sound collection order to the outside, so that the input/output portion 303 presents the sound collection time corresponding to the sound collection position falling on the first in the sound collection order to the outside.

Next, the sound collection portion 307 conducts sound collection for a predetermined sound collection time by using the microphone 313 mounted on the diagnosis device 3 to obtain sound data from the microphone 313 (step S206). The sound collection portion 307 may determine whether a predetermined sound collection time has elapsed. In a case where determination is made that the predetermined sound collection time has not elapsed, the processing may return to step S204, so that the current position determination portion 306 may determine whether the current position of the diagnosis device 3 coincides with the sound collection position. In a case where determination is made that the predetermined sound collection time has elapsed, the processing may proceed to step S207.

After the predetermined sound collection time elapses, the sound collection portion 307 obtains log data including drive mode information, room fan operation information, and louver operation information from the log storage portion 302 (step S207). As described above, since when the state of the electric apparatus 1 changes, log data is received and stored in the log storage portion 302, log data indicative of a current state of the electric apparatus 1 is stored in the log storage portion 302. Therefore, the sound collection portion 307 obtains log data indicative of the state of the electric apparatus 1 at a time point where the sound data is obtained.

Next, the sound collection portion 307 stores a sound collection position, log data, and sound data in the sound data storage portion 308 (step S208). After the sound collection position, the log data, and the sound data are stored in the sound data storage portion 308, the sound collection portion 307 outputs the model, the diagnosis target part, and the sound collection order to the sound collection completion determination portion 309. The sound collection completion determination portion 309 receives the model, the diagnosis target part, and the sound collection order from the sound collection portion 307.

Next, the sound collection completion determination portion 309 determines whether sound collection at all the sound collection positions included in the sound collection positional information is completed (step S209). In other words, the sound collection completion determination portion 309 refers to the sound collection positional information stored in the sound collection positional information storage portion 304 to determine whether a current sound collection order is the last sound collection order. When determining that the current sound collection order is the last sound collection order, the sound collection completion determination portion 309 determines that sound collection at all the sound collection positions is completed. When determining that the current sound collection order is not the last sound collection order, the sound collection completion determination portion 309 determines that sound collection at all the sound collection positions is not completed.

Here, in a case where the determination is made that sound collection is not completed at all the sound collection positions (NO in step S209), the sound collection completion determination portion 309 obtains a subsequent sound collection order and outputs the obtained sound collection order to the sound collection position presenting portion 305 to return the processing to step S203. In step S203, the sound collection position presenting portion 305 causes the input/output portion 303 to display a sound collection position falling on the second in the sound collection order. Then, the processing of step S203 to step S209 will be repeated until completion of sound collection at all the sound collection positions.

By contrast, in a case where the determination is made that sound collection at all the sound collection positions is completed (YES in step S209), the sound collection completion determination portion 309 outputs a sound collection completion signal to the diagnosis possible/impossible determination portion 310 (step S210). The diagnosis possible/impossible determination portion 310 receives the sound collection completion signal from the sound collection completion determination portion 309.

Next, the diagnosis possible/impossible determination portion 310 determines whether diagnosis of an abnormal sound of the electric apparatus 1 is possible using the obtained sound data, based on the log data stored in the sound data storage portion 308 (step S211). At this time, the diagnosis possible/impossible determination portion 310 obtains information indicative of an operation state of a diagnosis target part from log data corresponding to each of the plurality of sound collection positions to determine whether all the obtained information is identical to each other. In a case, for example, where the diagnosis target part is "room fan", the diagnosis possible/impossible determination portion 310 obtains room fan operation information from the log data corresponding to each of the plurality of sound collection positions to determine whether all the obtained room fan operation information is identical to each other. When determining that all the obtained information is identical to each other, the diagnosis possible/impossible determination portion 310 determines that diagnosis of an abnormal sound is possible. When determining that all the obtained information is not identical to each other, the diagnosis possible/impossible determination portion 310 determines that diagnosis of an abnormal sound is impossible.

Here, in a case where determination is made that diagnosis of an abnormal sound is impossible (NO in step S211), the processing returns to step S202, so that the sound collection position presenting portion 305 of the diagnosis device 3 again obtains sound collection positional information corresponding to the input model and diagnosis target part from the sound collection positional information storage portion 304. Then, processing of step S202 to step S211 will be repeated until sound collection at all the sound collection positions is completed and determination is made that diagnosis of an abnormal sound is possible.

When determining that diagnosis of an abnormal sound is impossible, the diagnosis possible/impossible determination portion 310 may obtain the first sound collection order and output the obtained sound collection order to the sound collection position presenting portion 305 to return the processing to step S203. In this case, in step S203, the sound collection position presenting portion 305 may cause the input/output portion 303 to display a sound collection position falling on the first in the sound collection order. Then, processing of step S203 to step S211 may be repeated until sound collection at all the sound collection positions is completed and determination is made that diagnosis of an abnormal sound is possible.

By contrast, in a case where determination is made that diagnosis of an abnormal sound is possible (YES in step S211), the diagnosis processing portion 311 obtains all the sound collection positions, and sound data corresponding to all the sound collection positions from the sound data storage portion 308, conducts filter processing corresponding to the sound collection position of the microphone 313 by using all the obtained sound collection positions and all the sound data, and emphasizes an abnormal sound from a diagnosis target sound source (step S212). In a case where determination is made that diagnosis of an abnormal sound is possible, the diagnosis possible/impossible determination portion 310 may output a diagnosis allowance signal to the diagnosis processing portion 311. The diagnosis processing portion 311 may receive the diagnosis allowance signal from the diagnosis possible/impossible determination portion 310.

Next, the diagnosis processing portion 311 diagnoses an abnormal sound from an emphasized diagnosis target sound source (step S213).

Next, the diagnosis processing portion 311 causes the input/output portion 303 to display a diagnosis result (step S214). The diagnosis processing portion 311 instructs the input/output portion 303 to present a diagnosis result to the outside, so that the input/output portion 303 presents the diagnosis result to the outside.

As described in the foregoing, in a case where an electric apparatus as a diagnosis target changes each time in the present embodiment, an abnormal sound can be diagnosed with high precision by simple configuration without using a special mechanism for rotating at least one microphone.

(Modification)

While in the present embodiment, determination whether the current position of the diagnosis device 3 and a sound collection position coincide with each other is conducted using a two-dimensional code physically printed on the surface of the main body of the electric apparatus 1 as a diagnosis target, the determination may be made using other information which enables the current position of the diagnosis device 3 to be specified. For example, the determination whether the current position of the diagnosis device 3 and a sound collection position coincide with each other may be made using information detected by an acceleration sensor or a gyro sensor mounted on the diagnosis device 3.

FIG. 22 is a diagram showing one example of a data configuration of the sound collection positional information storage portion in a first modification of the present embodiment. The first sound collection position as a reference is represented by a two-dimensional code similarly to the above embodiment, and each of the second and subsequent sound collection positions is represented by a movement direction and a moving distance of the diagnosis device 3 with respect to one preceding sound collection position. The current position determination portion 306 determines, by using the acceleration sensor or the gyro sensor, whether the diagnosis device 3 has moved in designated direction and distance. For example, a sound collection position of "LEFT 10 cm" indicates that from one preceding sound collection position, the diagnosis device 3 is moved 10 cm in the left direction. This enables determination of a sound collection position without printing a plurality of two-dimensional codes in the electric apparatus 1 as a diagnosis target. As a sensor to be used, not only an acceleration sensor or a gyro sensor but also other sensor may be used. For example, a distance between the electric apparatus 1 as a diagnosis target and the diagnosis device 3 may be estimated using a level of sound data obtained from the microphone 313.

Additionally, while in the present embodiment, the diagnosis possible/impossible determination portion 310 determines whether diagnosis of an abnormal sound is possible after sound collection at all the sound collection positions is completed, the present disclosure is not limited thereto. For example, when sound data and log data of the electric apparatus 1 are obtained, the diagnosis possible/impossible determination portion 310 may determine whether the log data obtained this time is identical to the log data obtained last time.

Figure 23:
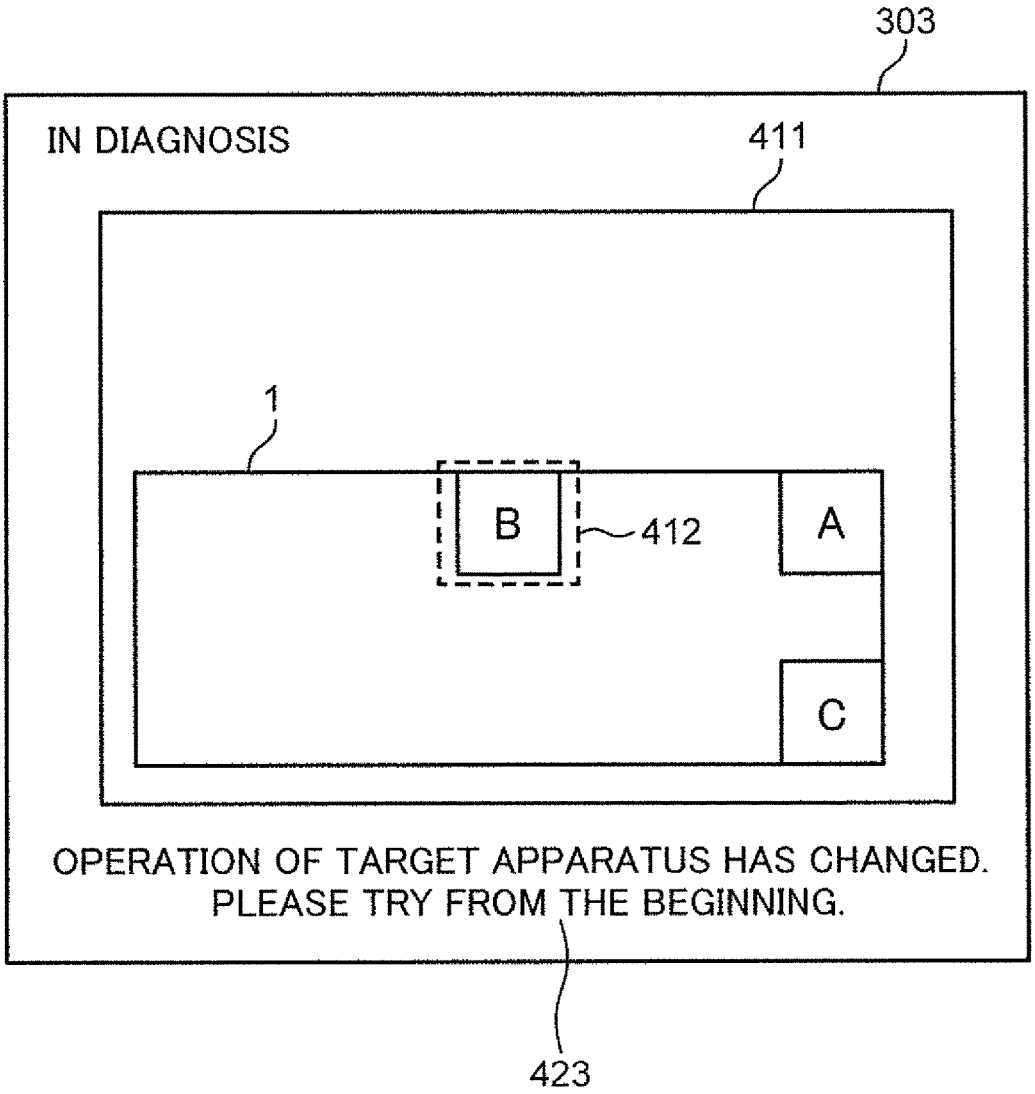
FIG. 23 is a diagram showing one example of a diagnosis screen displayed on the diagnosis device when determination that diagnosis of an abnormal sound is impossible is made in course of sound collection in a second modification of the present embodiment.

FIG. 23 is a diagram showing one example of a diagnosis screen displayed on the diagnosis device when determination that diagnosis of an abnormal sound is impossible is made in course of sound collection in a second modification of the present embodiment.

The diagnosis possible/impossible determination portion 310 may determine whether diagnosis of an abnormal sound of the electric apparatus 1 is possible every time log data is obtained from the log storage portion 302 after obtaining sound data. After the sound collection portion 307 obtains log data from the log storage portion 302 in step S207 of FIG. 20, the diagnosis possible/impossible determination portion 310 determines whether information indicative of an operation state of a diagnosis target part in the log data obtained this time is identical to information indicative of an operation state of a diagnosis target part in the log data obtained last time. When determining that the information obtained this time is identical to the information obtained last time, the diagnosis possible/impossible determination portion 310 determines that diagnosis of an abnormal sound is possible. When determining that the information obtained this time is not identical to the information obtained last time, the diagnosis possible/impossible determination portion 310 determines that diagnosis of an abnormal sound is impossible.

In a case where determination is made that diagnosis of an abnormal sound of the electric apparatus 1 is impossible, the input/output portion 303 displays the diagnosis screen shown in FIG. 23. In FIG. 23, there are displayed, on the diagnosis screen, the screen image 411 being photographed by the photographing portion 312, the detection area 412, and a message 423 which notifies that diagnosis of an abnormal sound of the electric apparatus 1 is impossible and guides to again collect sound starting with the first sound collection position A. In FIG. 23, since the state of the electric apparatus 1 has changed at the time of sound collection at the second sound collection position B, it is notified that diagnosis of an abnormal sound of the electric apparatus 1 becomes impossible.

As a result, since determination whether diagnosis of an abnormal sound of the electric apparatus 1 is possible is made every time sounds are collected at the plurality of sound collection positions, unnecessary sound collection processing can be reduced.

In the present embodiment, the above first modification and second modification may be combined.

In the present disclosure, all or a part of the units, the devices, the members, or the portions, or all or a part of functional blocks of the block diagrams shown in the drawings may be executed by one or a plurality of electronic circuits including a semiconductor device, a semiconductor integrated circuit (IC), or large scale integration (LSI). LSI or IC may be integrated on one chip or configured by combining a plurality of chips. For example, a functional block other than a storage element may be integrated on one chip. LSI or IC here can be differently referred to according to the degree of integration, and may be referred to as a system LSI, very large scale integration (VLSI), or ultra large scale integration (ULSI). A field programmable gate array (FPGA) programmed after the manufacture of LSI, or a reconfigurable logic device allowing reconfiguration of LSI internal joining or allowing set-up of an LSI internal circuit section can be also used for the same purpose.

Further, all or a part of the units, the devices, the members, or the portions, or all or a part of function or operation can be executed by software processing. In this case, software is recorded in one or a plurality of non-transitory recording media such as ROM, an optical disk, or a hard disk drive, and when the software is executed by a processing device (processor), function specified by the software is executed by the processing device (processor) and a peripheral device. The system or the device may include one or a plurality of non-transitory recording media on which software is recorded, a processing device (processor), and a required hardware device such as an interface.

The diagnosis method, the diagnosis device, and the computer-readable recording medium on which the diagnosis program is recorded according to the present disclosure enable diagnosis of an abnormal sound with high precision by simple configuration, and are useful as a diagnosis method of diagnosing an abnormal sound of an electric apparatus, a diagnosis device, and a computer-readable recording medium on which a diagnosis program is recorded.

This application is based on Japanese Patent application No. 2018-30473 filed in Japan Patent Office on Feb. 23, 2018, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A diagnosis method in a diagnosis device which diagnoses an abnormal sound of an electric apparatus, the diagnosis method comprising:

from a sound collection position storage portion which stores at least two sound collection positions of an abnormal sound of the electric apparatus, obtaining the at least two sound collection positions and giving an instruction to present the at least two sound collection positions to an outside;

comparing a current position of the diagnosis device and one sound collection position of the at least two sound collection positions presented;

obtaining sound data indicative of an abnormal sound of the electric apparatus collected by a microphone, based on a comparison result and storing the obtained sound data in a sound data storage portion so as to be correlated with log data obtained from the electric apparatus and the one sound collection position;

determining whether sound collection at the at least two sound collection positions presented is completed;

determining whether diagnosis of an abnormal sound of the electric apparatus is possible, based on at least two items of log data correlated with at least two items of sound data stored in the sound data storage portion; and diagnosing an abnormal sound of the electric apparatus by using the at least two items of sound data and at least two sound collection positions correlated with the at least two items of sound data which are stored in the sound data storage portion, based on a determination result whether sound collection is completed and a determination result whether diagnosis of an abnormal sound is possible.

2. The diagnosis method according to claim 1, wherein in the determination whether diagnosis of an abnormal sound of the electric apparatus is possible, the determination is made that diagnosis of an abnormal sound of the electric apparatus is possible in a case where all of predetermined items are identical to each other in the at least two items of log data.

3. The diagnosis method according to claim 1, wherein the determination whether diagnosis of an abnormal sound of the electric apparatus is possible is made after determination is made that sound collection at the at least two sound collection positions is completed.

4. The diagnosis method according to claim 1, further comprising:

obtaining the log data of the electric apparatus after obtaining sound data indicative of an abnormal sound of the electric apparatus, wherein the determination whether diagnosis of an abnormal sound of the electric apparatus is possible is made every time the log data is obtained.

5. The diagnosis method according to claim 1, wherein the diagnosis of an abnormal sound of the electric apparatus is conducted by emphasizing an abnormal sound of the electric apparatus and diagnosing the emphasized abnormal sound using the at least two items of sound data and the at least two sound collection positions which are stored in the sound data storage portion.

6. The diagnosis method according to claim 1, wherein the sound collection position storage portion stores a model of the electric apparatus, a diagnosis target part corresponding to the abnormal sound in the electric apparatus, and the at least two sound collection positions so as to be correlated with each other, the diagnosis method further comprising:

obtaining model information for specifying the model of the electric apparatus, and diagnosis target part information for specifying the diagnosis target part in the electric apparatus, wherein in the instruction to present the at least two sound collection positions, the at least two sound collection positions correlated with the obtained model information and diagnosis target part information are obtained from the sound collection position storage portion.

7. The diagnosis method according to claim 1, further comprising:

receiving the log data from the electric apparatus;

storing the received log data in a log storage portion; and obtaining the log data from the log storage portion after obtaining sound data indicative of an abnormal sound of the electric apparatus.

8. The diagnosis method according to claim 1, further comprising:

giving an instruction to present a diagnosis result.

9. The diagnosis method according to claim 1, wherein position specifying information for specifying the at least two sound collection positions is applied to a surface of the electric apparatus, the diagnosis method further comprising:

obtaining an image of the electric apparatus photographed by a photographing portion provided in the diagnosis device; and displaying the obtained image on a display portion provided in the diagnosis device, and wherein in the comparison between the current position of the diagnosis device and the one sound collection position, determination is made whether the image displayed on the display portion includes the position specifying information corresponding to the one sound collection position of the presented at least two sound collection positions.

10. A diagnosis device which diagnoses an abnormal sound of an electric apparatus, the diagnosis device comprising:

a sound collection position storage portion which stores at least two sound collection positions of an abnormal sound of the electric apparatus;

an instruction portion which obtains the at least two sound collection positions from the sound collection position storage portion to give an instruction to present the at least two sound collection positions to an outside;

a comparison portion which compares a current position of the diagnosis device and one sound collection position of the at least two sound collection positions presented;

a sound data storage portion which stores at least two items of sound data, at least two items of log data of the electric apparatus, and the at least two sound collection positions so as to be correlated with each other, a sound collection portion which obtains sound data indicative of an abnormal sound of the electric apparatus collected by a microphone, based on a comparison result, and stores the obtained sound data in the sound data storage portion so as to correlated with the log data obtained from the electric apparatus and the one sound collection position;

a completion determination portion which determines whether sound collection at the at least two sound collection positions presented is completed;

a diagnosis determination portion which determines whether diagnosis of an abnormal sound of the electric apparatus is possible, based on at least two items of log data correlated with at least two items of sound data stored in the sound data storage portion; and a diagnosis portion which diagnoses an abnormal sound of the electric apparatus by using the at least two items of sound data and at least two sound collection positions correlated with the at least two items of sound data which are stored in the sound data storage portion, based on a determination result of the completion determination portion and a determination result of the diagnosis determination portion.

11. A non-transitory computer-readable recording medium which records a diagnosis program for diagnosing an abnormal sound of an electric apparatus, in which the diagnosis program causes a processor to execute the processing of:

from a sound collection position storage portion which stores at least two sound collection positions of an abnormal sound of the electric apparatus, obtaining the at least two sound collection positions to give an instruction to present the at least two sound collection positions to an outside;

comparing a current position of the diagnosis device and one sound collection position of the at least two sound collection positions presented;

obtaining sound data indicative of an abnormal sound of the electric apparatus collected by a microphone, based on a comparison result and storing the obtained sound data in a sound data storage portion so as to be correlated with log data obtained from the electric apparatus and the one sound collection position;

determining whether sound collection at the at least two sound collection positions presented is completed;

determining whether diagnosis of an abnormal sound of the electric apparatus is possible, based on at least two items of log data correlated with at least two items of sound data stored in the sound data storage portion; and diagnosing an abnormal sound of the electric apparatus by using the at least two items of sound data and at least two sound collection positions correlated with the at least two items of sound data which are stored in the sound data storage portion, based on a determination result whether sound collection is completed and a determination result whether diagnosis of an abnormal sound is possible.

* * * * *